US009826796B2

(12) United States Patent
Marvin et al.

(10) Patent No.: US 9,826,796 B2
(45) Date of Patent: Nov. 28, 2017

(54) SOLE WITH PROJECTIONS AND ARTICLE OF FOOTWEAR

(71) Applicant: Reebok International Limited, London (GB)

(72) Inventors: William Marvin, Canton, MA (US); Matthew Montross, Middleboro, MA (US); Ricardo Vestuti, Providence, RI (US); Henry Hardigan, Chapel Hill, NC (US)

(73) Assignee: Reebok International Limited, London (GB)

( * ) Notice: Subject to any disclaimer, the term of this patent is extended or adjusted under 35 U.S.C. 154(b) by 5 days.

(21) Appl. No.: 14/724,383

(22) Filed: May 28, 2015

(65) Prior Publication Data

US 2015/0327626 A1 Nov. 19, 2015

Related U.S. Application Data

(63) Continuation of application No. 12/890,266, filed on Sep. 24, 2010, now Pat. No. 9,144,264.

(51) Int. Cl.

| | |
|---|---|
| ***A43B 13/12*** | (2006.01) |
| ***A43B 13/18*** | (2006.01) |
| ***A43B 13/22*** | (2006.01) |

(52) U.S. Cl.

CPC ..... *A43B 13/181* (2013.01); *A43B 13/12* (2013.01); *A43B 13/184* (2013.01); *A43B 13/186* (2013.01); *A43B 13/187* (2013.01); *A43B 13/188* (2013.01); *A43B 13/223* (2013.01)

(58) Field of Classification Search

CPC ..... A43B 5/06; A43B 13/00; A43B 13/12; A43B 13/14; A43B 13/18; A43B 13/181; A43B 13/184; A43B 13/186

USPC ..... 36/25 R, 28, 31, 102, 103, 141

See application file for complete search history.

(56) References Cited

U.S. PATENT DOCUMENTS

| | | | |
|---|---|---|---|
| 500,385 | A | 6/1893 | Hall |
| 2,068,238 | A | 1/1937 | Malm |
| 2,155,166 | A | 4/1939 | Kraft |
| 2,188,168 | A | 1/1940 | Winkel |

(Continued)

FOREIGN PATENT DOCUMENTS

| | | | |
|---|---|---|---|
| CH | 216930 | A | 9/1941 |
| DE | 201097 | C1 | 11/1907 |

(Continued)

OTHER PUBLICATIONS

"KICKSstyle" in The International Street Magazine, pp. 54-55, Aug. 20, 2001 (with translation of p. 55).

(Continued)

*Primary Examiner* — Sharon M Prange

(74) *Attorney, Agent, or Firm* — Sterne, Kessler, Goldstein & Fox P.L.L.C.

(57) ABSTRACT

A sole for an article of footwear includes a base having an outer edge defining a perimeter, the base having a forefoot portion, a midfoot portion and a heel portion; and a plurality of resilient projections extending from the base, wherein the plurality of projections includes a plurality of projections extending non-orthogonally from the base about the perimeter of the base and a plurality of projections extending substantially orthogonally from the base within the non-orthogonal projections.

31 Claims, 16 Drawing Sheets

(56) References Cited

U.S. PATENT DOCUMENTS

| | | | |
|---|---|---|---|
| 2,224,590 | A | 12/1940 | Boivin |
| 2,860,425 | A | 11/1958 | Jackson |
| 3,148,378 | A | 9/1964 | Tibbitts |
| 3,634,954 | A | 1/1972 | Larsen et al. |
| 3,648,109 | A | 3/1972 | Tims et al. |
| 3,724,107 | A | 4/1973 | Makinen et al. |
| 3,762,075 | A | 10/1973 | Munschy |
| D236,563 | S | 9/1975 | Wunsch |
| 4,043,326 | A | 8/1977 | Little et al. |
| 4,118,878 | A | 10/1978 | Semon |
| 4,265,032 | A | 5/1981 | Levine |
| 4,309,831 | A | 1/1982 | Pritt |
| 4,309,832 | A | 1/1982 | Hunt |
| 4,327,503 | A | 5/1982 | Johnson |
| 4,393,604 | A | 7/1983 | Crowley |
| 4,402,145 | A | 9/1983 | Dassler |
| 4,443,511 | A | 4/1984 | Worden et al. |
| 4,498,251 | A | 2/1985 | Shin |
| 4,516,336 | A | 5/1985 | Nissenbaum |
| D281,642 | S | 12/1985 | Fuzita |
| 4,607,440 | A | 8/1986 | Roberts et al. |
| 4,631,755 | A | 12/1986 | Zingg et al. |
| D288,027 | S | 2/1987 | Tonkel |
| 4,642,917 | A | 2/1987 | Ungar |
| 4,843,741 | A | 7/1989 | Yung-Mao |
| RE33,018 | E | 8/1989 | Ostrander |
| 4,905,382 | A | 3/1990 | Yung-Mao |
| 4,908,962 | A | 3/1990 | Yung-Mao |
| 4,908,964 | A | 3/1990 | Deem |
| 4,944,099 | A | 7/1990 | Davis |
| 5,127,170 | A | 7/1992 | Messina |
| 5,265,349 | A | 11/1993 | Munschy |
| 5,400,526 | A | 3/1995 | Sessa |
| 5,548,910 | A | 8/1996 | Klingseis |
| 5,551,173 | A | 9/1996 | Chambers |
| 5,584,077 | A | 12/1996 | Thrift |
| D378,472 | S | 3/1997 | Bramani |
| D380,889 | S | 7/1997 | Earle |
| D385,392 | S | 10/1997 | Cass |
| D394,944 | S | 6/1998 | Doxey |
| 5,832,539 | A | 11/1998 | Williams |
| 5,901,467 | A | 5/1999 | Peterson et al. |
| 5,956,868 | A | 9/1999 | Stevens et al. |
| D416,669 | S | 11/1999 | Parr et al. |
| D421,832 | S | 3/2000 | Loveder |
| 6,052,921 | A | 4/2000 | Oreck |
| 6,061,929 | A | 5/2000 | Ritter |
| D429,062 | S | 8/2000 | Santa |
| 6,115,945 | A | 9/2000 | Ellis, III |
| 6,128,835 | A | 10/2000 | Ritter et al. |
| D440,031 | S | 4/2001 | White |
| D449,729 | S | 10/2001 | Von Conta |
| 6,295,742 | B1 | 10/2001 | Bathum |
| 6,298,583 | B1 | 10/2001 | Allen |
| D452,061 | S | 12/2001 | Smith |
| 6,367,166 | B1 | 4/2002 | Barthelemy et al. |
| D470,999 | S | 3/2003 | Schroeder et al. |
| D474,586 | S | 5/2003 | Recchi |
| D475,514 | S | 6/2003 | Burg et al. |
| 6,584,704 | B2 | 7/2003 | March |
| 6,634,121 | B2 | 10/2003 | Sordi |
| 6,684,532 | B2 | 2/2004 | Greene et al. |
| D492,095 | S | 6/2004 | Sanchez et al. |
| D496,779 | S | 10/2004 | Belley et al. |
| D502,308 | S | 3/2005 | Teague |
| 6,860,037 | B1 | 3/2005 | Norek |
| 6,990,755 | B2 | 1/2006 | Hatfield et al. |
| D521,715 | S | 5/2006 | Lotti |
| D530,493 | S | 10/2006 | Holmes |
| 7,140,129 | B2 | 11/2006 | Newson et al. |
| 7,168,190 | B1 | 1/2007 | Gillespie |
| D538,519 | S | 3/2007 | McCiaskie |
| D543,340 | S | 5/2007 | Favreau et al. |
| D552,837 | S | 10/2007 | Scott |
| 7,290,357 | B2 | 11/2007 | McDonald et al. |
| D560,336 | S | 1/2008 | Nakashima et al. |
| D561,438 | S | 2/2008 | Belley |
| D561,440 | S | 2/2008 | Andersen et al. |
| 7,392,605 | B2 | 7/2008 | Hatfield et al. |
| D581,641 | S | 12/2008 | Bethke, Jr. |
| D584,491 | S | 1/2009 | Matis |
| D584,492 | S | 1/2009 | Lee |
| D586,991 | S | 2/2009 | Fuerst |
| D586,992 | S | 2/2009 | Duffy |
| 7,607,241 | B2 | 10/2009 | McDonald et al. |
| 7,637,035 | B1 | 12/2009 | Gillespie |
| 7,650,707 | B2 | 1/2010 | Campbell et al. |
| D609,896 | S | 2/2010 | Christie |
| 7,748,141 | B2 | 7/2010 | Smith et al. |
| 7,762,008 | B1 | 7/2010 | Clark et al. |
| 7,788,827 | B2 | 9/2010 | Fogg et al. |
| 7,793,432 | B2 | 9/2010 | Chan et al. |
| D626,320 | S | 11/2010 | Anderson |
| D630,420 | S | 1/2011 | Truelsen |
| D632,879 | S | 2/2011 | Merkazy et al. |
| 7,941,938 | B2 | 5/2011 | Yu et al. |
| 7,946,058 | B2 | 5/2011 | Johnson et al. |
| D642,362 | S | 8/2011 | Miner |
| D643,195 | S | 8/2011 | Yi |
| 8,020,320 | B2 | 9/2011 | Gillespie |
| D650,975 | S | 12/2011 | Menghi |
| 8,104,197 | B2 | 1/2012 | Flannery et al. |
| D653,437 | S | 2/2012 | Mongelli |
| D654,259 | S | 2/2012 | Hatfield |
| D655,901 | S | 3/2012 | Raysse |
| D656,304 | S | 3/2012 | Debiase |
| 8,186,078 | B2 * | 5/2012 | Avar ..... A43B 1/0009 36/103 |
| D675,002 | S | 1/2013 | Marvin et al. |
| D711,636 | S | 8/2014 | Christensen et al. |
| 2003/0093920 | A1 | 5/2003 | Greene et al. |
| 2004/0123495 | A1 | 7/2004 | Greene et al. |
| 2005/0262739 | A1 | 12/2005 | McDonald et al. |
| 2006/0201028 | A1 | 9/2006 | Chan et al. |
| 2007/0193065 | A1 * | 8/2007 | Nishiwaki ..... A43B 13/184 36/27 |
| 2007/0266592 | A1 | 11/2007 | Smith et al. |
| 2008/0022553 | A1 | 1/2008 | McDonald et al. |
| 2008/0060228 | A1 | 3/2008 | Morgan et al. |
| 2008/0229617 | A1 | 9/2008 | Johnson et al. |
| 2008/0244926 | A1 | 10/2008 | Yu et al. |
| 2009/0013559 | A1 | 1/2009 | Chan et al. |
| 2010/0126043 | A1 | 5/2010 | Loverin et al. |
| 2010/0180474 | A1 | 7/2010 | Clark et al. |
| 2011/0016749 | A1 | 1/2011 | Callahan et al. |
| 2011/0061265 | A1 | 3/2011 | Lyden |
| 2011/0078922 | A1 | 4/2011 | Cavaliere et al. |
| 2011/0113646 | A1 | 5/2011 | Merritt et al. |
| 2011/0154688 | A1 | 6/2011 | Yu et al. |
| 2011/0185590 | A1 | 8/2011 | Nishiwaki et al. |
| 2011/0214313 | A1 | 9/2011 | James et al. |
| 2011/0289799 | A1 | 12/2011 | Keating et al. |
| 2013/0167401 | A1 | 7/2013 | Christensen et al. |
| 2013/0167402 | A1 | 7/2013 | Christensen et al. |

FOREIGN PATENT DOCUMENTS

| | | | |
|---|---|---|---|
| DE | 1636455 | U | 3/1952 |
| DE | 862102 | C1 | 1/1953 |
| DE | 940756 | C1 | 3/1956 |
| DE | 1914002 | U | 4/1965 |
| DE | 6924927 | U | 6/1969 |
| DE | 1485821 | A | 1/1970 |
| DE | 3630738 | A | 3/1988 |
| DE | 8907333 | U | 12/1989 |
| DE | 9303653 | U | 6/1993 |
| DE | 44 17 563 | A1 | 11/1995 |
| FR | 1281619 | A | 12/1961 |
| FR | 2578725 | A3 | 10/1986 |
| GB | 028488 | A | 0/1912 |
| JP | H02-023129 | Y | 6/1990 |
| JP | H03-012249 | Y | 3/1991 |
| JP | H01-297201 | A | 10/1992 |
| JP | 3011970 | U | 3/1995 |

(56) References Cited

FOREIGN PATENT DOCUMENTS

| | | | |
|---|---|---|---|
| JP | H07-236503 | A | 9/1995 |
| JP | H08-131201 | A | 5/1996 |
| JP | 3045628 | U | 11/1997 |
| JP | H10-179204 | A | 7/1998 |
| JP | 2000-106902 | A | 4/2000 |
| JP | 2000-201704 | A | 7/2000 |
| JP | 2001-057901 | A | 3/2001 |
| JP | 2001-061509 | A | 3/2001 |
| JP | 2003-516781 | A | 5/2003 |
| KE | S59-072901 | U | 5/1984 |
| NL | 273850 | A | 9/1964 |
| NL | 9400255 | A | 10/1995 |

OTHER PUBLICATIONS

Partial European Search Report; European Patent Application No. 11182300, I-1658; dated Sep. 29, 2014.

* cited by examiner

SOLE WITH PROJECTIONS AND ARTICLE OF FOOTWEAR

CROSS-REFERENCE TO RELATED APPLICATIONS

This application is a continuation of U.S. application Ser. No. 12/890,266, filed Sep. 24, 2010, the disclosure of which is expressly incorporated herein by reference thereto in its entirety.

BACKGROUND OF THE INVENTION

Field of the Invention

Embodiments of the present invention generally relate to soles and articles of footwear having soles, and more particularly relate to an article of footwear having projections extending from a sole of the article of footwear.

Background Art

Individuals are often concerned with the amount of flexibility and cushioning an article of footwear provides, as well as the aesthetic appeal of the article of footwear. This is true for articles of footwear worn for non-performance activities, such as a leisurely stroll, and for performance activities, such as running, because throughout the course of an average day, the feet and legs of an individual are subjected to substantial impact forces. When an article of footwear contacts a surface, considerable forces may act on the article of footwear and, correspondingly, the wearer's foot. The sole functions, in part, to cushion the wearer's foot and to protect it from these forces. To achieve adequate cushioning, many footwear soles are relatively thick and heavy, which can greatly reduce the flexibility of the sole. When sole size and/or weight are reduced to achieve other performance goals, protection of the wearer's foot is often compromised.

The human foot is a complex and remarkable piece of machinery, capable of withstanding and dissipating many impact forces. The natural padding of fin at the heel and forefoot, as well as the flexibility of the arch, help to cushion the foot. An athlete's stride is partly the result of energy which is stored in the flexible tissues of the foot. For example, a typical gait cycle for running or walking begins with a "heel strike" and ends with a "toe-off". During the gait cycle, the main distribution of forces on the foot begins adjacent to the lateral side of the heel (outside of the foot) during the "heel strike" phase of the gait, then moves toward the center axis of the foot in the arch area, and then moves to the medial side of the forefoot area (inside of the foot) during "toe-off". During a typical walking or running stride, the Achilles tendon and the arch stretch and contract, storing and releasing energy in the tendons and ligaments. When the restrictive pressure on these elements is released, the stored energy is also released, thereby reducing the burden which must be assumed by the muscles.

Although the human foot possesses natural cushioning and rebounding characteristics, the foot alone is incapable of effectively overcoming many of the forces encountered during every day activity. Unless an individual is wearing shoes which provide proper cushioning and support, the soreness and fatigue associated with every day activity is more acute, and its onset accelerated. The discomfort for the wearer that results may diminish the incentive for further activity. Equally important, inadequately cushioned footwear can lead to injuries such as blisters; muscle, tendon and ligament damage; and bone stress fractures. Improper footwear can also lead to other ailments, including back pain.

Proper footwear should complement the natural functionality of the foot, in part, by incorporating a sole (typically including an outsole, midsole and insole) which absorbs shocks. Therefore, a continuing need exists for innovations in providing cushioning to articles of footwear.

BRIEF SUMMARY OF THE INVENTION

In one embodiment of the present invention, a sole for an article of footwear comprises: a base having an outer edge defining a perimeter, the base having a forefoot portion, a midfoot portion and a heel portion; and a plurality of resilient projections extending from the base, wherein the plurality of resilient projections includes a plurality of projections extending non-orthogonally from the base about the perimeter of the base and a plurality of projections extending substantially orthogonally from the base within the non-orthogonal projections.

In another embodiment of the present invention, a sole for an article of footwear, comprises: a base having an outer edge defining a perimeter, the base having a forefoot portion, a midfoot portion and a heel portion; and a plurality of resilient outer projections extending from the base about the perimeter, each outer projection having a central axis; and a plurality of resilient inner projections extending from the base within the outer projections, each inner projection having a central axis, wherein the central axes of the plurality of inner projections are substantially parallel, and wherein the central axes of the plurality of outer projections are non-parallel with the central axes of the plurality of inner projections.

In another embodiment of the present invention, a sole for an article of footwear comprises: a base having an outer edge defining a perimeter, the base having a forefoot portion, a midfoot portion and a heel portion; and a plurality of foam projections extending from the base, each projection having a sidewall and a bottom surface, wherein a portion of the sidewall of a plurality of projections forms a continuous surface with the outer edge of the base, and wherein the plurality of projections define spaces separating the projections such that the spaces comprise at least about 30% of the total area of the base.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

The present invention will now be described in detail with reference to embodiments thereof as illustrated in the accompanying figures. While specific configurations and arrangements are discussed, it should be understood that this is done for illustrative purposes only. References to "an embodiment", "one embodiment", "another embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the spirit and scope of the invention to affect such feature, structure, or characteristic in connection with other embodiments whether or not explicitly described.

Figure 1:
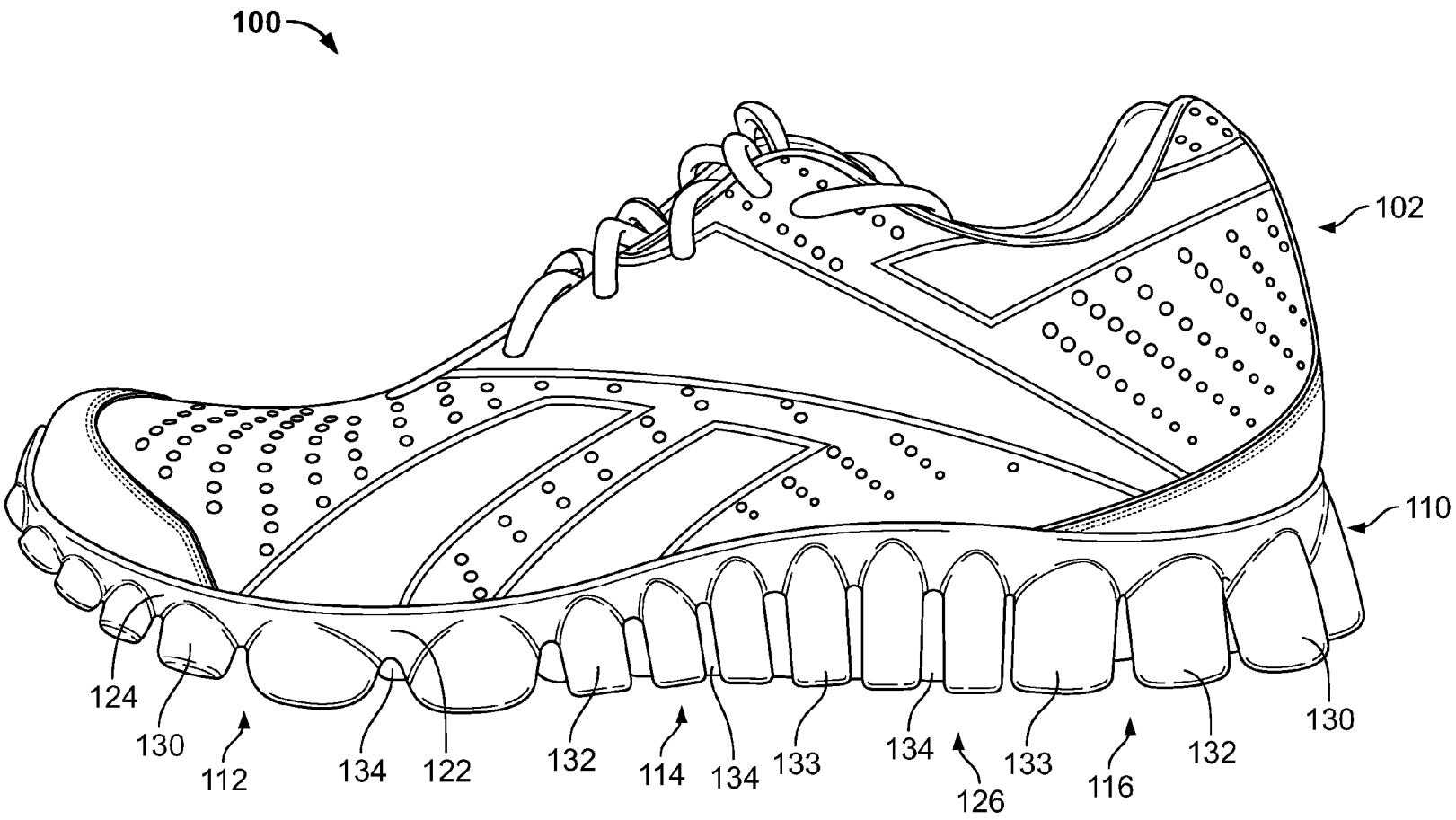
FIG. 1 is a medial side view of an exemplary sole and article of footwear according to an embodiment of the present invention.
Figure 2:
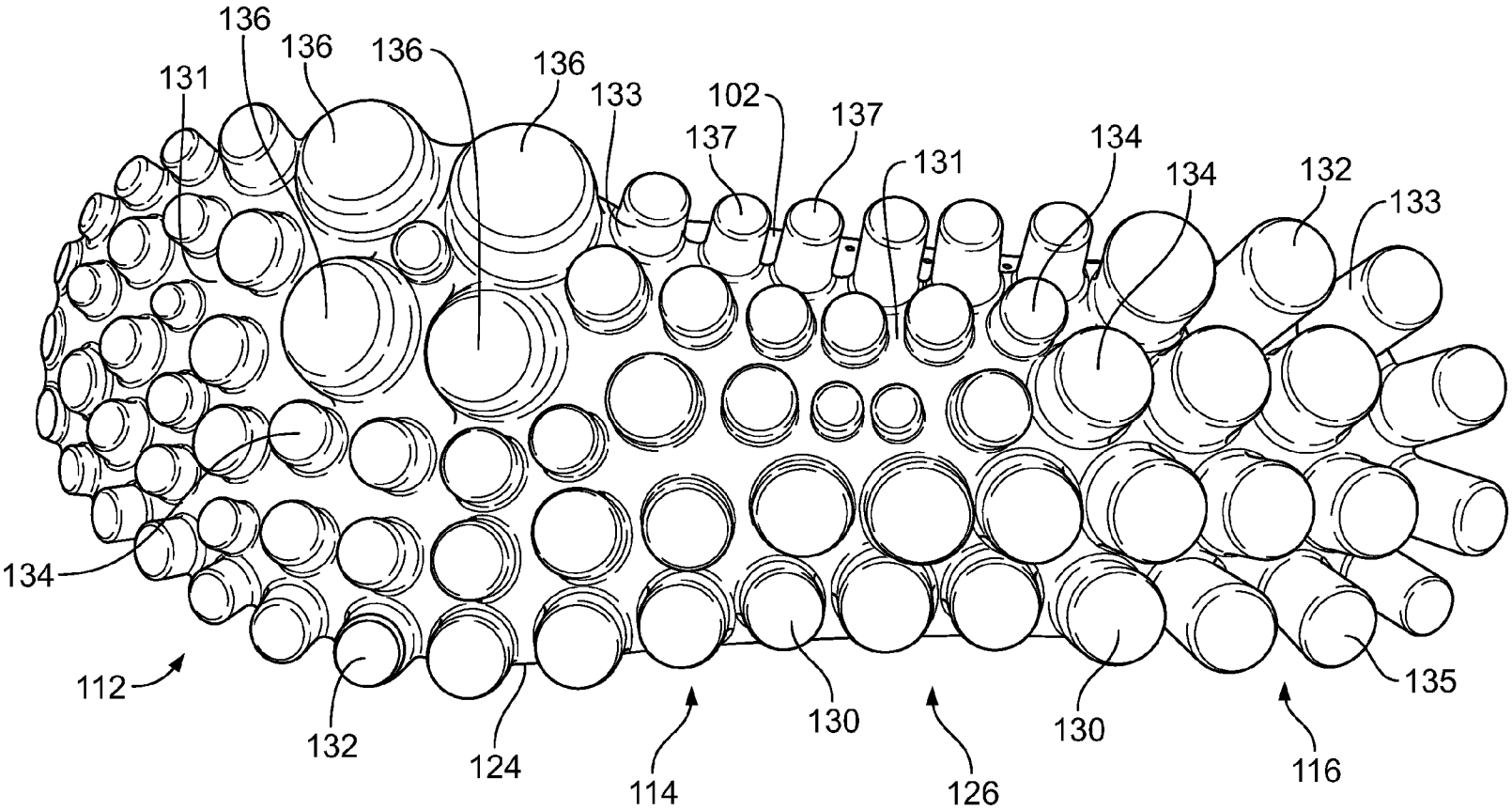
FIG. 2 is a bottom view of the exemplary sole and article of footwear of FIG. 1 according to an embodiment of the present invention.
Figure 3:
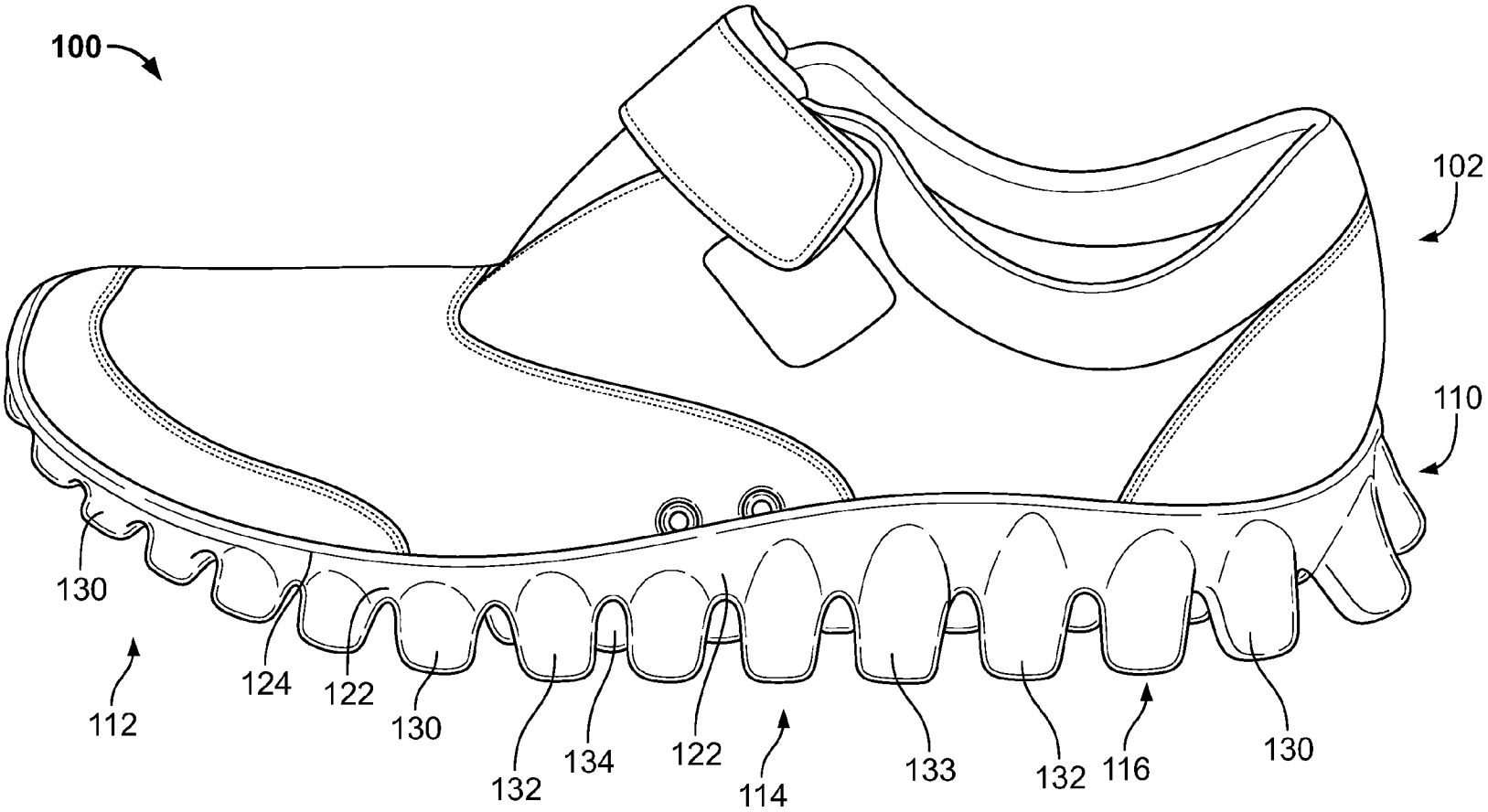
FIG. 3 is a lateral side view of an exemplary sole and article of footwear according to an embodiment of the present invention.
Figure 4:
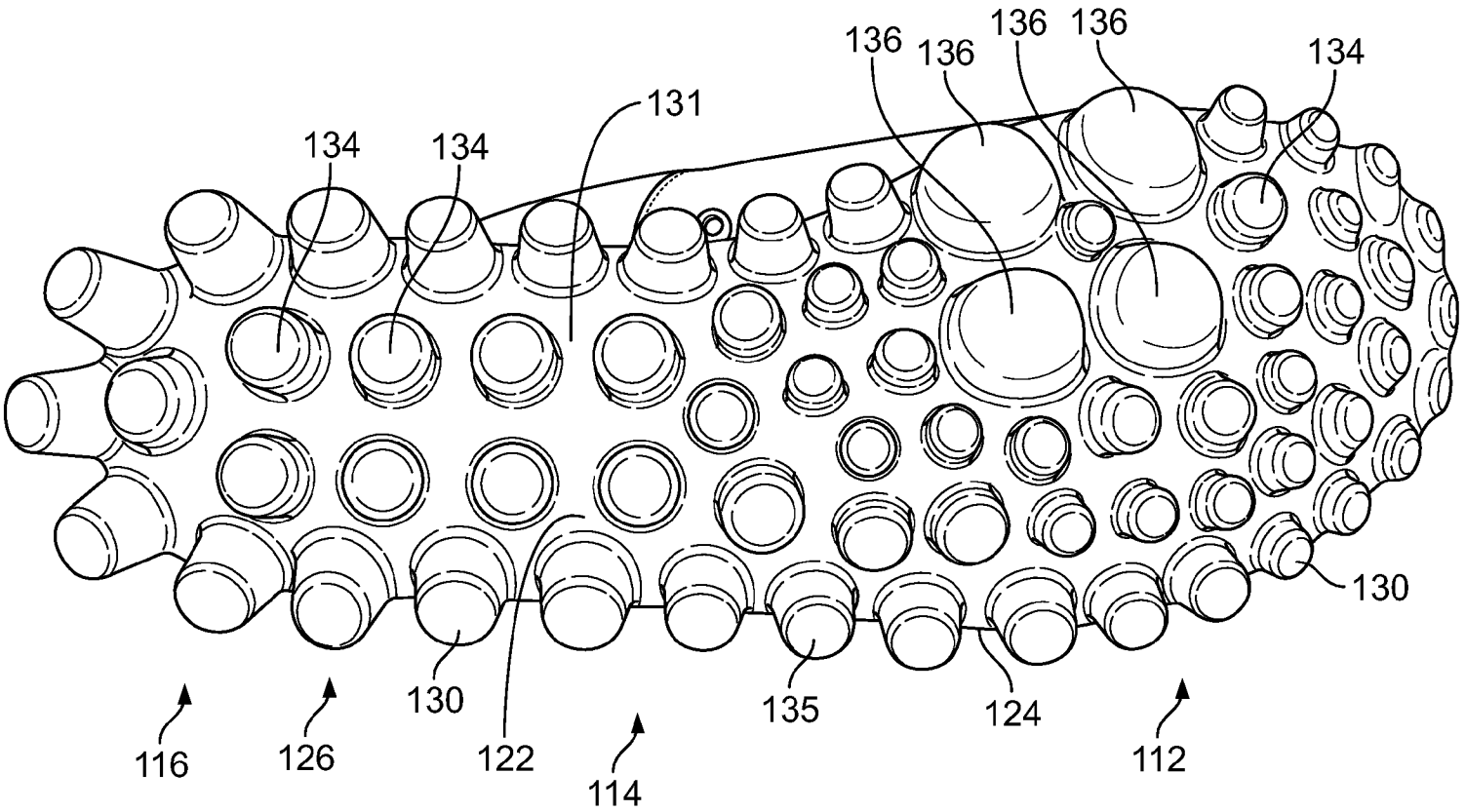
FIG. 4 is a bottom view of the exemplary sole and article of footwear of FIG. 3 according to an embodiment of the present invention.

With reference to FIGS. 1 and 2, an exemplary embodiment of an article of footwear, in particular a shoe, according to the present invention generally referred to by reference numeral 100 is shown. Although the article of footwear 100 may be referred to herein as footwear 100, it is contemplated that it may comprise any type of footwear in which the sole of the present invention may be desirable, including, but not limited to, walking shoes, running shoes, basketball shoes, court shoes, tennis shoes, training shoes, boots, and sandals. To the extent that only the left or right article of footwear 100 is described for a particular embodiment of the present invention, it will be apparent to one of ordinary skill in the art that the article of footwear 100 suitable for the other foot, even if not specifically described, may in some embodiments comprise a mirror image of the described article of footwear 100.

The footwear 100 includes a sole 110 having a forefoot portion 112, a midfoot portion 114, and a heel portion 116. The sole 110 includes a base 122 having an outer edge 124 which defines the perimeter 126 of the base 122. A plurality of projections 130 extend outwardly and downwardly from the base 122. The projections 130 may include a plurality of outer projections 132 extending from the base 122 about the perimeter 126, and a plurality of inner projections 134 extending from the base 122 within the perimeter 126 and the outer projections 132. The projections 130 define spaces 131 between the projections. In one embodiment, as shown for example in FIG. 2, a plurality of outer projections 132 may be disposed about the entire perimeter 126 of the base 122. In other embodiments, outer projections 132 may be disposed only about a portion of the perimeter 126.

As shown for example in FIG. 2, in one embodiment a plurality of projections 130 extend from the base 122 in the forefoot portion 112, the midfoot portion 114, and the heel portion 116 of the sole 110. In other embodiments, a plurality of projections 130 may extend from the base 122 in one or more of the forefoot portion 112, the midfoot portion 114, and the heel portion 116.

In one embodiment, the base 122 of the sole 110 may not have a constant thickness. For example, the base 122 may be thicker in the heel portion 116, and thinner in the forefoot portion 112, and the thickness may gradually increase in thickness from the heel portion to the forefoot. In another embodiment, the base 122 may have a uniform thickness.

In one embodiment, the footwear 100 may further include an upper 102 which may be formed to generally accommodate a human foot, and may comprise one or more textiles made of natural or man-made fibers. Materials appropriate for the upper 102 including, but not limited to, synthetic material, leather, rubber, and plastic, are considered to be within the scope of the present invention.

In one embodiment, the sole 110 may comprise a resilient material such that the sole provides a flexible ride and desired cushioning to the wearer. In one embodiment, the sole 110 comprises foam, such as, for example, ethyl vinyl acetate (EVA) foam or polyurethane (PU) foam, and the foam may be an open-cell foam or a closed-cell foam. In other embodiments, sole 110 may comprise elastomers, thermoplastic elastomers (TPE), foam-like plastic (e.g., Pebax® foam or Hytrel® foam), gel-like plastics, and combinations thereof. In one embodiment, the sole 110 may include a molded thermoplastic component such as, for example, an injection molded TPU component. In one embodiment of the present invention, an insole and/or sockliner may also be included within the footwear 100. In some embodiments, the sole 110 may include an insole and/or sockliner, in some embodiments, a plate may be disposed between the projections 130 and the wearer's foot. The plate may comprise, for example, compressed cellulose, plastic, TPU, and the like. The projections could extend from the plate, or the plate could be disposed over the base 122 from which the projections extend. One exemplary embodiment of a plate 400 is discussed below.

In one embodiment, the base 122 and the plurality of projections 130 comprise the same material. For example, the base 122 and the plurality of projections 130 may comprise foam. In other embodiments, the base 122 and the plurality of projections 130 may comprise different materials. For example, in one embodiment, the base 122 may comprise a harder material, such as, for example, a plastic, and the plurality of projections 130 may comprise a more resilient material such as, for example, foam. In one embodiment, the base 122 and the projections 130 may be formed together (e.g., co-molded) as a unitary structure by injection molding, compression molding, or other suitable techniques.

In other embodiments, the base 122 and the projections 130 may be formed separately and the projections may be attached to the base.

In one embodiment, the plurality of projections 130 may comprise different materials. For example, the outer projections 132 may comprise a different material than the inner projections 134. The outer projections 132, for example, may comprise at less resilient material to provide stability at the outer portions of the sole, and the inner projections 134 may comprise a more resilient material for cushioning. In another embodiment, a plurality of projections 130 in the heel portion 116 may comprise a different material than a plurality of projections 13Q in the midfoot portion 114 and/or the forefoot portion 112.

As shown in FIGS. 1-11, for example, the size, shape, number, and arrangement of the projections 130 may be varied depending on the desired level of flexibility and/or cushioning to be provided by the sole 110. The projections 130 may be cylindrical, rectangular, quadrilateral, triangular, rhomboidal, spherical or semi-spherical, conical, elliptical, irregular, or other suitable shape. The sole 111 may include projections 130 having all the same shape, or may include projections having different shapes. In one embodiment, the sole 110 may include projections 130 having different sizes. In another embodiment, the sole 110 may include projections 130 having all the same size.

With reference to FIGS. 1-4, in one embodiment, a plurality of cylindrical projections 130 extend downwardly from the base 122. The projections 130 include a sidewall 133 extending from the base 122 at one end and terminating in a bottom surface 135 at another end. The sidewall 133 may be elongated and curved such that the projections 130 provide a generally cylindrical shape. The bottom surface 135 may be substantially flat or may be rounded. In one embodiment, some or all of the bottom surfaces 135 may be ground contacting surfaces. In one embodiment, some of the bottom surfaces 135 may not contact the ground during normal use. In one embodiment, as shown, for example, in FIGS. 1 and 3, the sidewall 133 of one or more projections 130 forms a continuous surface with the outer edge 124 of the base 122. For example, in one embodiment, each of a plurality of outer projections 132 includes a sidewall 133 that forms a continuous surface with the outer edge 124 of the base 122.

Figure 5:
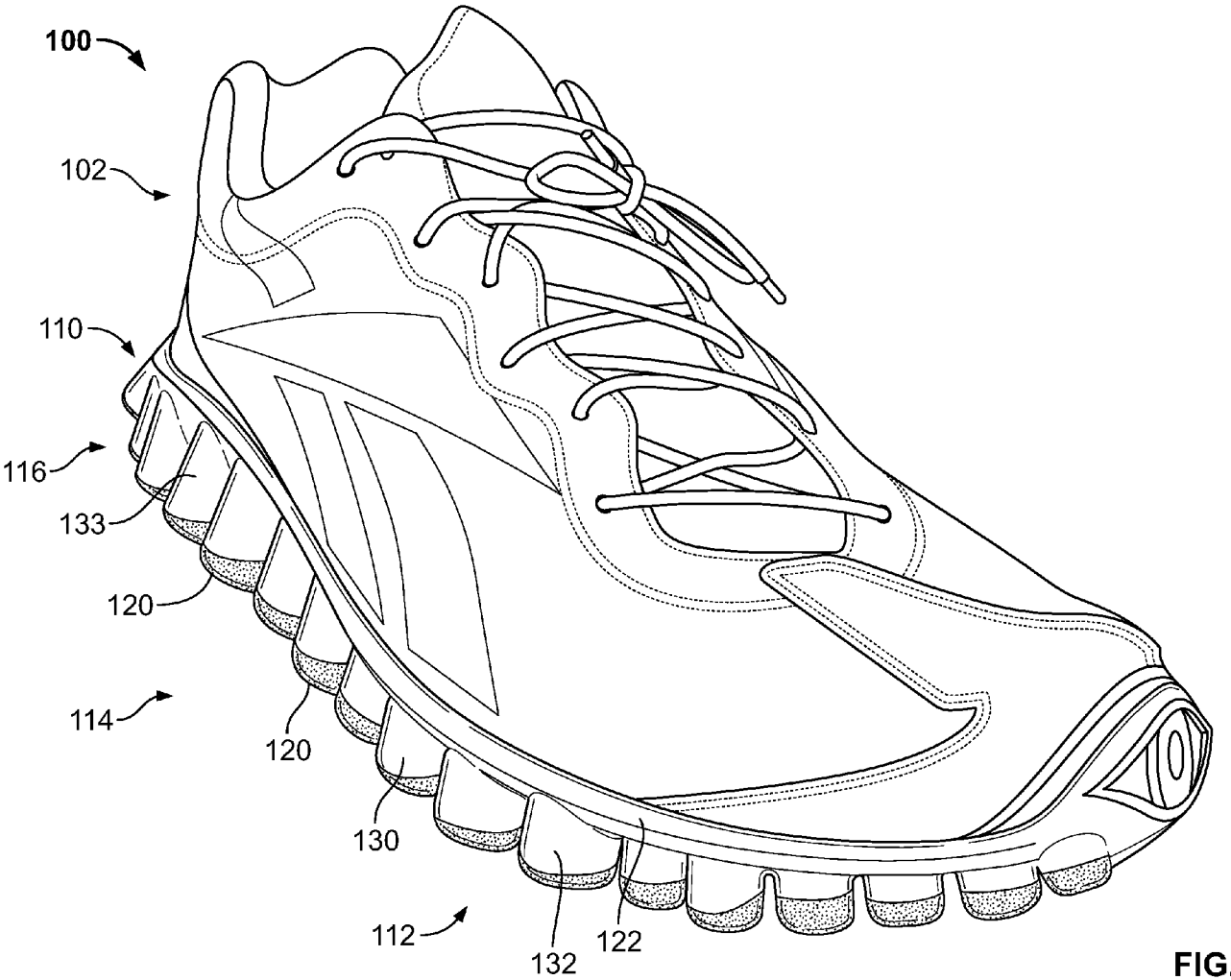
FIG. 5 is a perspective view of an exemplary sole having an outsole and article of footwear according to an embodiment of the present invention.
Figure 6:
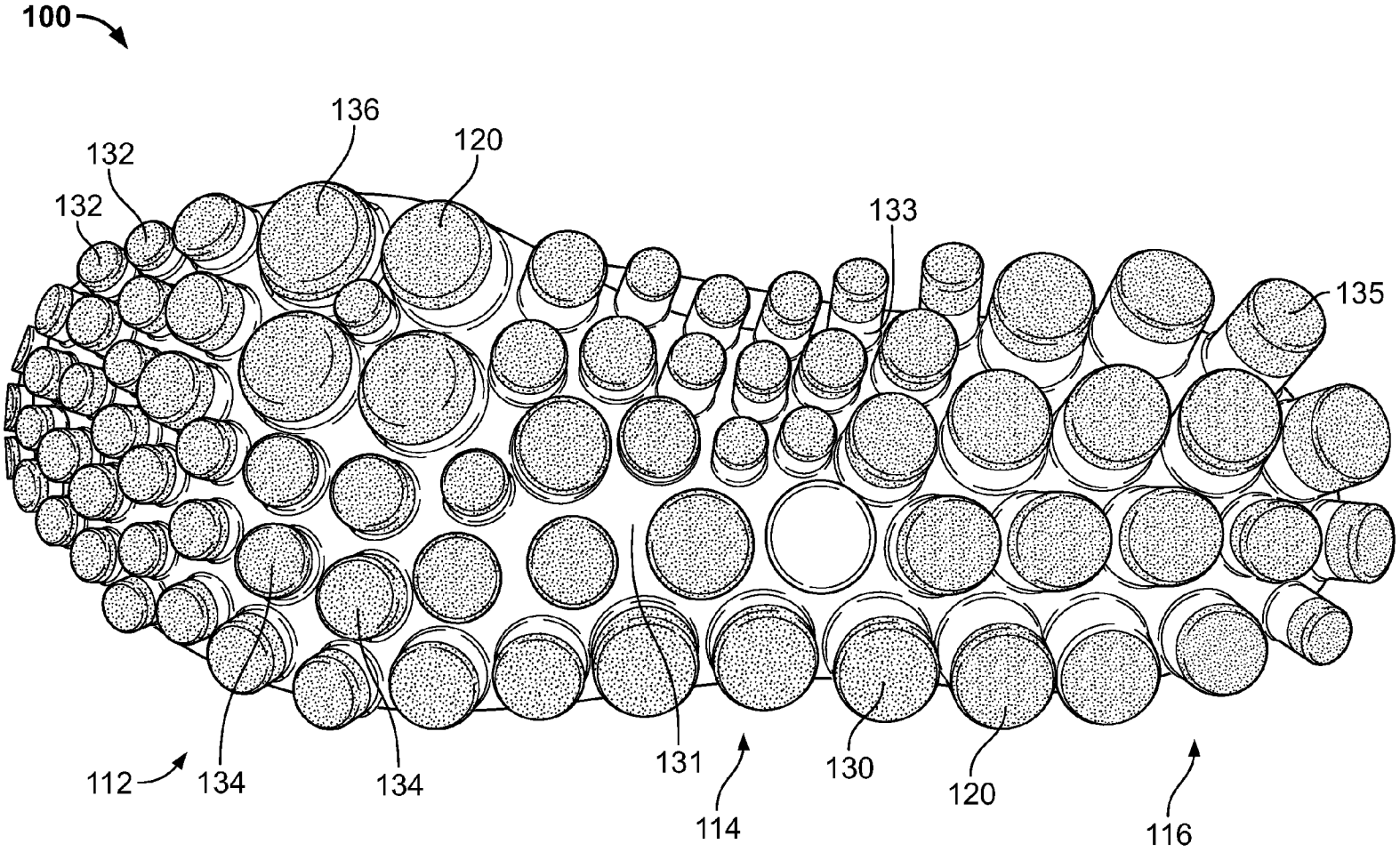
FIG. 6 is a bottom view of the exemplary sole and article of footwear of FIG. 5 of the present invention.

With reference to FIGS. 5 and 6, in one embodiment of the present invention an outsole 120 may be disposed on one or more of the projections 130, for example, on a bottom surface 135. The outsole 120 may comprise a wear-resistant material. For example, outsole 120 can include synthetic or natural rubber, polyurethane (e.g., thermoplastic polyurethane (TPU)), foam (e.g., a wear-resistant foam), or a combination thereof. In some embodiments, the sole 110 and the outsole 120 may be formed of the same or different material. In one embodiment, they may be molded together as a unitary structure.

In one embodiment, as best shown in FIG. 2, a plurality of projections 130 extend from the base 122 in the forefoot portion 112, the midfoot portion 114, and the heel portion 116. The projections 130 may have different diameters according to the location of the projections 130 on the sole 110. In one embodiment, the vertical height of projections 130 may generally decrease from heel portion 116 to forefoot portion 112. Generally, the projections 130 in the heel portion 116 may have a larger diameter and larger vertical height than the projections in the midfoot 114 and forefoot portions 112 of sole 110. The larger diameter projections 130 in the heel portion 116 may provide additional cushioning and/or more stability to the heel portion 116, which can experience large impact forces during the heel strike phase of a wearer's gait. In one embodiment, one or more projections 130 in heel portion 116 can also be formed of a higher density material in order to further buttress the cushioning and stability provided by the sole 110. As shown in FIG. 2, for example, in one embodiment, the projections 130 in the heel portion 116 may be more closely spaced than in the midfoot portion 114 or the forefoot portion 112 of the sole 110. The more narrow spaces 131 between the projections 130 may provide a clustering of projections in the heel portion and may provide additional cushioning and stability. By varying the vertical height, material density, and/or spacing 131 of projections 130, the flexibility, cushioning, and/or stability properties of sole 110 can be finely tuned.

In one embodiment, the rearmost projections 130 on the lateral side of the sole 110 may be of a smaller diameter than adjacent projections in the heel portion 116. In this manner, these projections may allow for a gradual increase in cushioning during heel strike as the smaller diameter projections 130 more readily deform and thereby absorb additional impact forces.

In one embodiment, larger projections 130 may be disposed in an area of the sole 110 corresponding to the ball of a wearer's foot, which may be the foot's pivot point during the gait cycle between the heel strike and the toe off. For example, the four largest projections 136 may be disposed on the medial side of the sole 110 in the forefoot portion 112. The projections 136 may be formed in a quadrilateral arrangement, as shown, for example, in FIG. 2. Two of the projections 136 may be disposed about the perimeter 126 and two projections 136 may be interiorly adjacent to these projections. The larger projections 136 may provide increased cushioning and stability to the ball of a wearer's foot, which is often an area that experiences high impact forces during the gait cycle. In one embodiment, a single projection 130 may be formed within the projections 136 in order to provide cushioning and support to the area in between these projections. In this manner, the projections at the pivot point of the sole 110 may form a quincunx arrangement.

In one embodiment, as shown, for example, in FIG. 2, a plurality of projections 137 disposed on the medial side of sole 110 in the midfoot portion 114 may also be of smaller diameter. The midfoot portion 114, and especially the medial side of midfoot portion 114, often experiences lower impact forces than other areas of a sole during normal use. As such, less cushioning may be necessary at this area. Thus, smaller diameter projections 137 may be used so as to avoid adding unnecessary weight to sole 110. Alternatively or in addition to using projections with a relatively small diameter, the projections 137 may be formed of lower density materials and/or may be spaced further apart from nearby projections 130 in order to achieve similar cushioning to weight tradeoff.

In one embodiment, the sole 110 may include one or more projections having a relatively high aspect ratio (ratio of the height of the projection to the width (or diameter) of the projection). For example, in one embodiment the sole 110 may include one or more projections in the heel portion 116 having a relatively high aspect ratio to provide improved cushioning. In one embodiment, the sole 110 may include a plurality of projections 130 having an aspect ratio of greater than 1. In another embodiment, the sole 110 may include a plurality of projections 130 having an aspect ratio of at least 2. In another embodiment, the sole 110 may include a plurality of projections 130 having an aspect ratio in the range of about 1 to about 2. The increased aspect ratio for a sole projection may improve flexibility, cushioning, and/or stability properties of sole 110. In some embodiments, the aspect ratio of the projections may vary. For example, in some embodiments, sole 110 may have a plurality of projections in the forefoot region having a lower aspect ratio than a plurality of projections in the heel region. In one embodiment, a plurality of projections in the forefoot region have an aspect ratio of about 1 or less such as about 0.5 to about 0.25 and a plurality of projections in the heel region have an aspect ratio of about 1 or greater such as about 1 to about 2.

In one embodiment, the sole 110 may include a plurality of projections 130 extending non-orthogonally from the base 122 and a plurality of projections 130 extending substantially orthogonally from the base 122. As shown, for example, in FIGS. 2 and 4, in one embodiment some or all of the outer projections 132 may extend non-orthogonally from the base 122, and some or all of the inner projections 134 may extend substantially orthogonally from the base 122. In one embodiment, all of the outer projections 132 about the entire perimeter 126 of the base 122 may extend non-orthogonally from the base 122 and all of the inner projections 134 within the outer projections 132 may extend substantially orthogonally from the base 122. In this manner, the outer projections 132 may be angled away from the center of the sole 110 to provide a larger footprint and additional stability to the footwear 100.

As shown, in FIG. 2, for example, the plurality of outer projections 132 include a central axis 132' (not shown) and a plurality of inner projections 134 include a central axis 134' (not shown). In one embodiment, the central axes of some or all of inner projections 134 are substantially parallel, and the central axes of some or all of outer projections 134 are non-parallel with the central axes of a plurality of inner projections 134.

Figure 7:
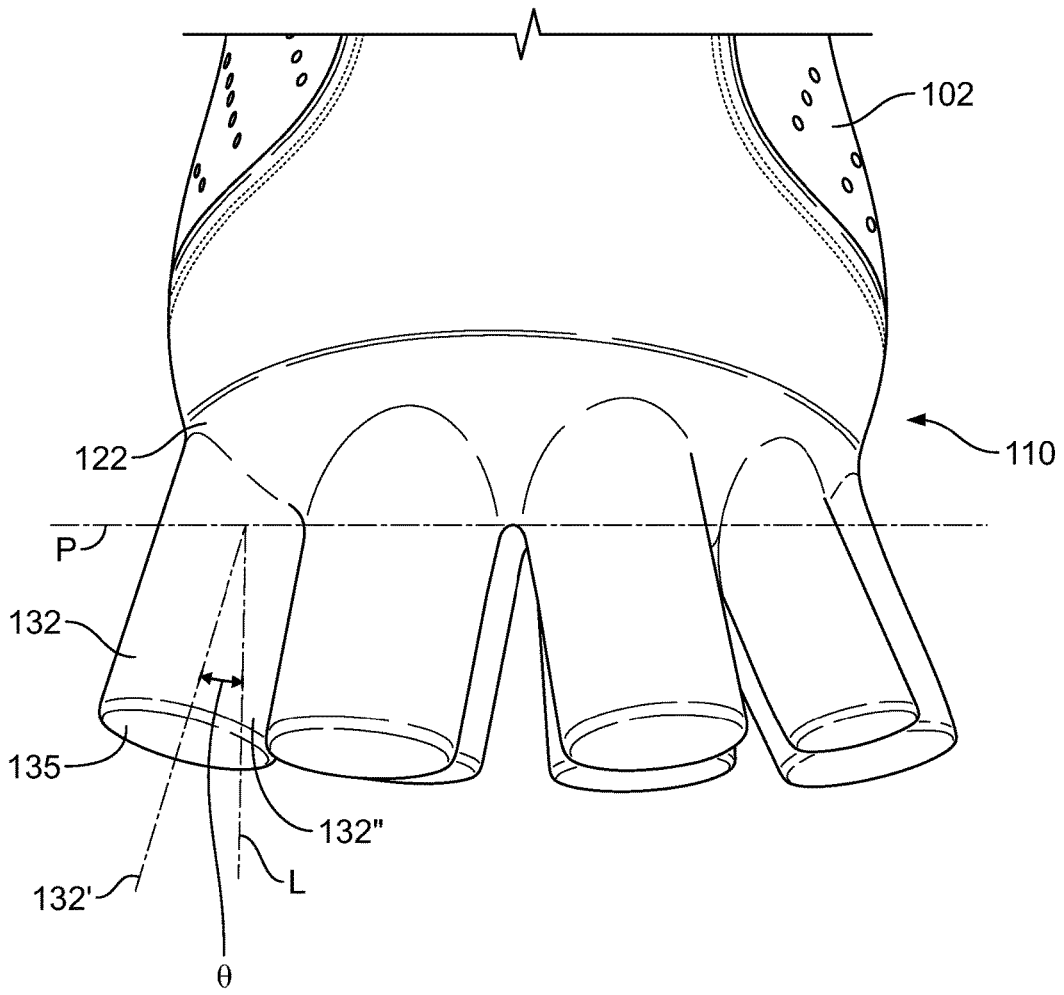
FIG. 7 is a partial rear view of an exemplary sole and article of footwear illustrating a protrusion splay angle according to an embodiment of the present invention.
Figure 8:
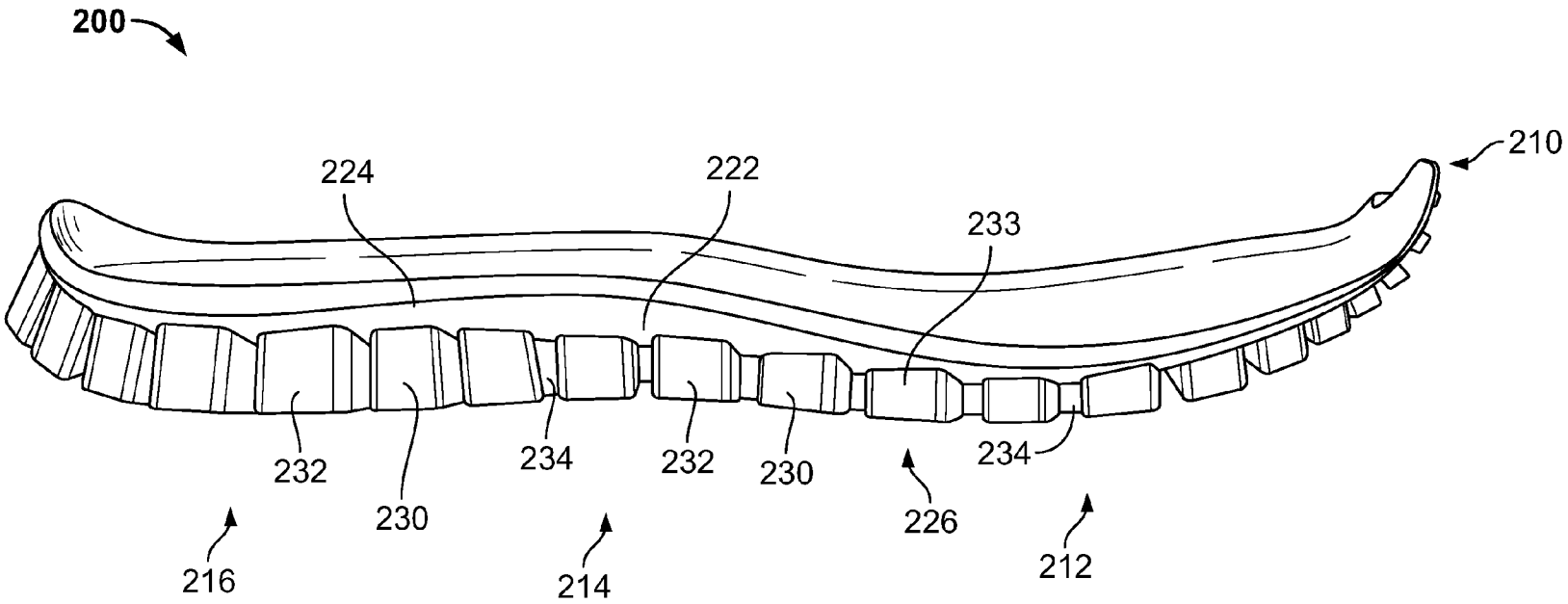
FIG. 8 is a side view of an exemplary sole for an article of footwear according to an embodiment of the present invention.

With reference to FIG. 7, in one embodiment a plurality of outer projections 132 include a central axis 132' and the base 122 defines a plane P. A plurality of outer projections 132 may be disposed at an angle Θ (splay angle) relative to a vertical line L orthogonal to the plane P. In one embodiment, a plurality of outer projections 132 are disposed at a splay angle of at least about 5 degrees. In one embodiment, a plurality of outer projections 132 are disposed at a splay angle of at least about 10 degrees. In one embodiment, a plurality of outer projections 132 are disposed at a splay angle in the range of about 5 degrees to about 45 degrees. In one embodiment, a plurality of outer projections 132 are disposed at a splay angle of about 5 degrees to about 30 degrees. In one embodiment, a plurality of outer projections 132 are disposed at a splay angle of about 10 degrees to about 30 degrees. In one embodiment, a plurality of outer projections 132 are disposed at a splay angle of about 10 degrees to about 25 degrees. In one embodiment, a plurality of outer projections 132 are disposed at a splay angle of about 14 degrees. In one embodiment, a plurality of outer projections 132 are disposed at a splay angle of about 21 degrees. In one embodiment, all of the outer projections 132 are provided at or above the splay angle. In one embodiment, some outer projections 132 may be provided at a different splay angle than other outer projections. Providing a plurality of outer projections 132 at the splay angle may provide increased cushioning and comfort to the wearer. As ground contact may occur at a corner of the projection (for example, corner 132" shown in FIG. 7), the projection 132 may gradually deform (and more of the column may be compressed) through the gait cycle. This may result in a gradual increase of the cushioning as the projection is compressed. In one embodiment, to reduce wear on high wear areas, such as, for example, the bottom surface 135 and/or corner 132" of the projections, a more wear resistant material for the projections may be used in these areas. For example, rubber or other wear resistant material may be used. Alternatively, a discrete cap (not shown) comprising wear resistant material may be disposed over one or more projections in high wear areas. As discussed above, in some embodiments outsole 120 may alleviate wear issues.

The number of projections 130 extending from sole 110 may be varied to provide the desired level of flexibility and/or cushioning. In one embodiment, the number of projections 130 comprises greater than 50 projections. In one embodiment, the number of projections 130 comprises greater than 70 projections. In one embodiment, the number of projections comprises about 80 projections. In one embodiment, the number of projections 130 comprises 81 projections. In one embodiment, the number of projections 130 comprises in the range of from about 70 projections to about 90 projections. In one embodiment, the number of projections 130 comprises in the range of from about 75 projections to about 85 projections.

In some embodiments, the large number of projections may allow various regions of the sole 110 to have desired characteristics while providing flexibility as to the overall sole design by varying, for example, the number, vertical height, splay angle, projection spacing, cross sectional area, density, shape, and diameter of projections. For example, in one embodiment, sole 110 may be provided with fewer projections 130 that are spaced farther apart. When fewer projections 130 are provided, the projections may be formed from higher density materials or may have a larger diameter such that the stability and cushioning of the sole 110 are not negatively affected. Alternatively, if a softer feel is desired for a particular embodiment, fewer projections 130 can be provided without using higher density materials or larger diameters.

The size, shape, and arrangement of the projections 130 and the spacing 131 may also provide improved ground contouring. In some embodiments the projections 130 may provide independent movement that may not be found in a conventional sole, and, as a result, may "self-level" so as to provide improved contour with the ground surface and/or better transmit tactile sensations of the ground surface to the wearer's foot.

In some embodiments, the independent movement of one or more projections relative to other projections and/or the base 122 may provide increased shear cushioning. When a force is applied to the sole, the sole material may compress, and the physical shape of the sole, including independently moving projections 130, may also change to absorb the compressive and shear forces. In addition, in some embodiments, the various projection characteristics described herein may vary the amount of time spent in each phase of the gait cycle for an individual compared to a more traditional running shoe, possibly decreasing the peak force experienced by that individual.

The arrangement and location of the projections 130 may also be varied to provide desired characteristics such as improved pressure distribution. In one embodiment, the cross sectional area, shape, and height of projections and the spacing 131 between projections may be selected to correspond with high and low areas of pressure acting on a wearer's foot (which may be determined, for example, by using a force plate on a foot or conventional sole during a gait cycle). For example, larger projections, connected projections, and/or projections spaced closer together may be located in high pressure areas for better cushioning and/or stability in the area. Smaller projections, unconnected projections, and/or projections spaced farther apart may be placed in lower pressure areas for better flexibility or weight savings in these areas. In one embodiment, the pressure areas of a user's gait may be determined and a custom sole 110, including custom characteristics of projections 130 described herein, may be created to correspond to high/low pressure areas.

With reference to FIGS. 8-11 in which like reference numerals refer to like elements, in one embodiment, a plurality of projections 230 having generally quadrilateral cross sections extend downwardly from the base 222 of the sole 210 of a shoe 200. The properties of the projections 230 including, but not limited to, the size, number, spacing, splay angle, and arrangement of the projections may be provided as those described above in connection with FIGS. 1-7, depending on the desired level of flexibility and/or cushioning to be provided by the sole 210.

The sole 210 includes a base 222 having an outer edge 224 which defines the perimeter 226 of the base 222. A plurality of projections 230 extend outwardly and downwardly from the base 222. The projections 230 may include a plurality of outer projections 232 extending from the base 222 about the perimeter 226, and a plurality of inner projections 234 extending from the base 222 within the perimeter 226 and the outer projections 232. The projections 230 define spaces 231 between the projections. In one embodiment, as shown for example in FIG. 9, a plurality of outer projections 232 may be disposed about the entire perimeter 226 of the base 222. In other embodiments, outer projections 232 may be disposed only about a portion of the perimeter 226.

The projections 230 include a sidewall 233 extending from the base 222 at one end and terminating in a bottom surface 235 at another end. In one embodiment, the sidewall 233 may be substantially flat and may generally comprise four sides such that the projections 230 have a generally quadrilateral cross section. As shown, for example, in FIGS. 9-11, the sole 210 may include projections 230 that are rectangular in cross-section, and some of the projections 230 that are square in cross section. It is contemplated that in some embodiments each side of the sidewall 233 may be curved. The bottom surface 235 may be substantially flat or may be rounded.

In one embodiment, the bottom surface 235 of one or more projections 230 may include an indention 238. The concavity provided by the indention 238 may soften the feel of the landing and may provide different traction than a flat bottom surface. The features of the bottom surface 235 such as the configuration, orientation, and shape of the indention 238 may be manipulated to provide the desired traction and cushioning for various athletic activities. In one embodiment, the bottom surface 235 may include ridges, bumps or raised areas, or the edges of the bottom surface may be sharpened, rounded, or hardened, for example, to provide the desired characteristic.

In one embodiment, some or all of the bottom surfaces 235 may be ground contacting surfaces. In one embodiment, some of the bottom surfaces 235 may not contact the ground during normal use. In one embodiment, as shown, for example, in FIG. 9, the sidewall 233 of one or more projections 230 forms a continuous surface with the outer edge 224 of the base 222. For example, in one embodiment, each of a plurality of outer projections 232 include a sidewall 233 that forms a continuous surface with the outer edge 224 of the base 222.

In one embodiment, the largest projections 250 may be disposed in the heel portion 216 of the sole 210. For example, large rectangular projections 236 may extend from the base 222 along the perimeter 226 of the medial side of the heel portion 216. The large rectangular projections 236 in the heel portion 216 may provide additional cushioning and/or stability to the heel portion 216, which can experience large impact forces during the heel strike phase of a wearer's gait.

Figure 9:
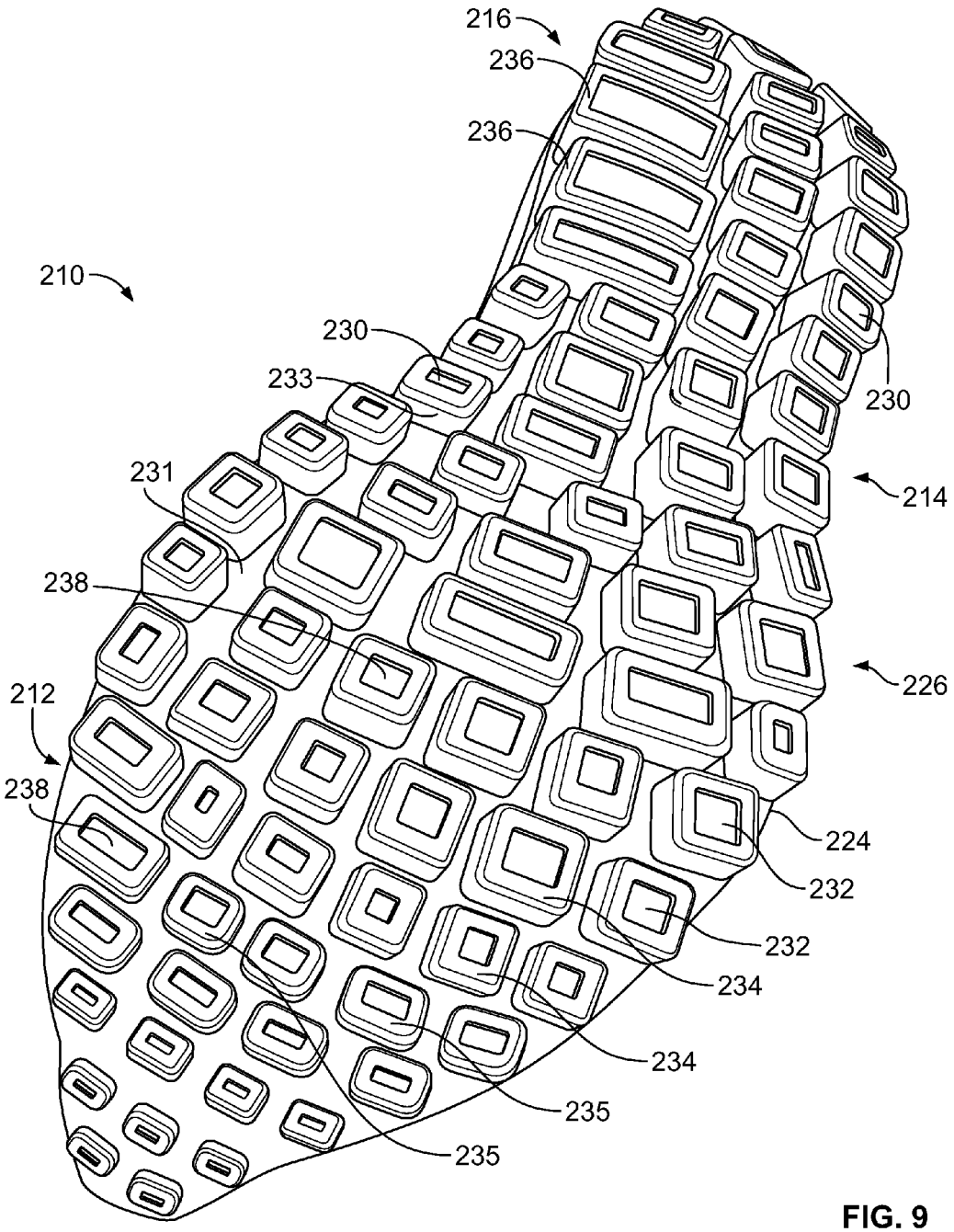
FIG. 9 is a bottom view of the exemplary sole of FIG. 8 according to an embodiment of the present invention.
Figure 10:
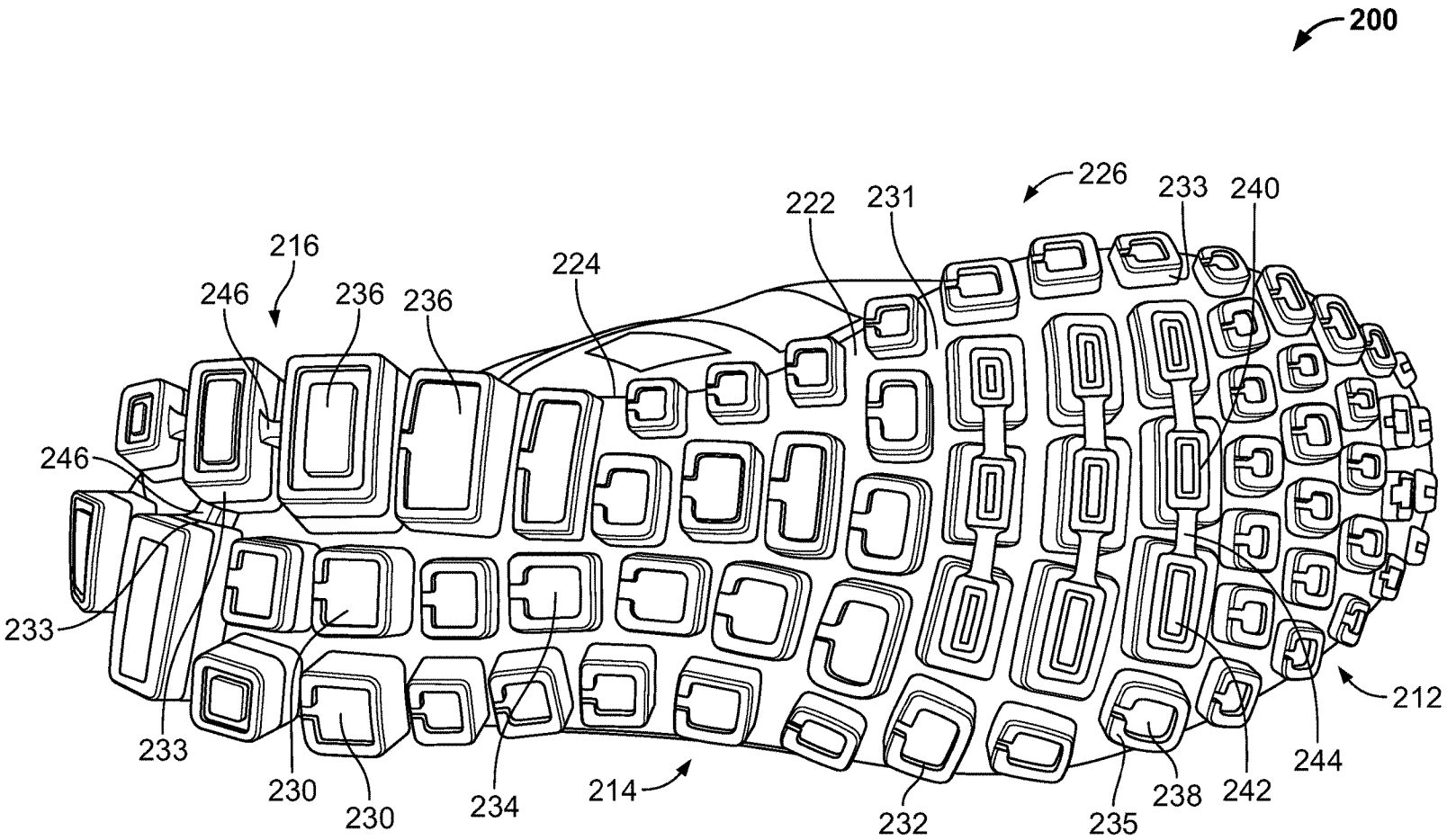
FIG. 10 is a bottom view of an exemplary sole and article of footwear according to an embodiment of the present invention.
Figure 11:
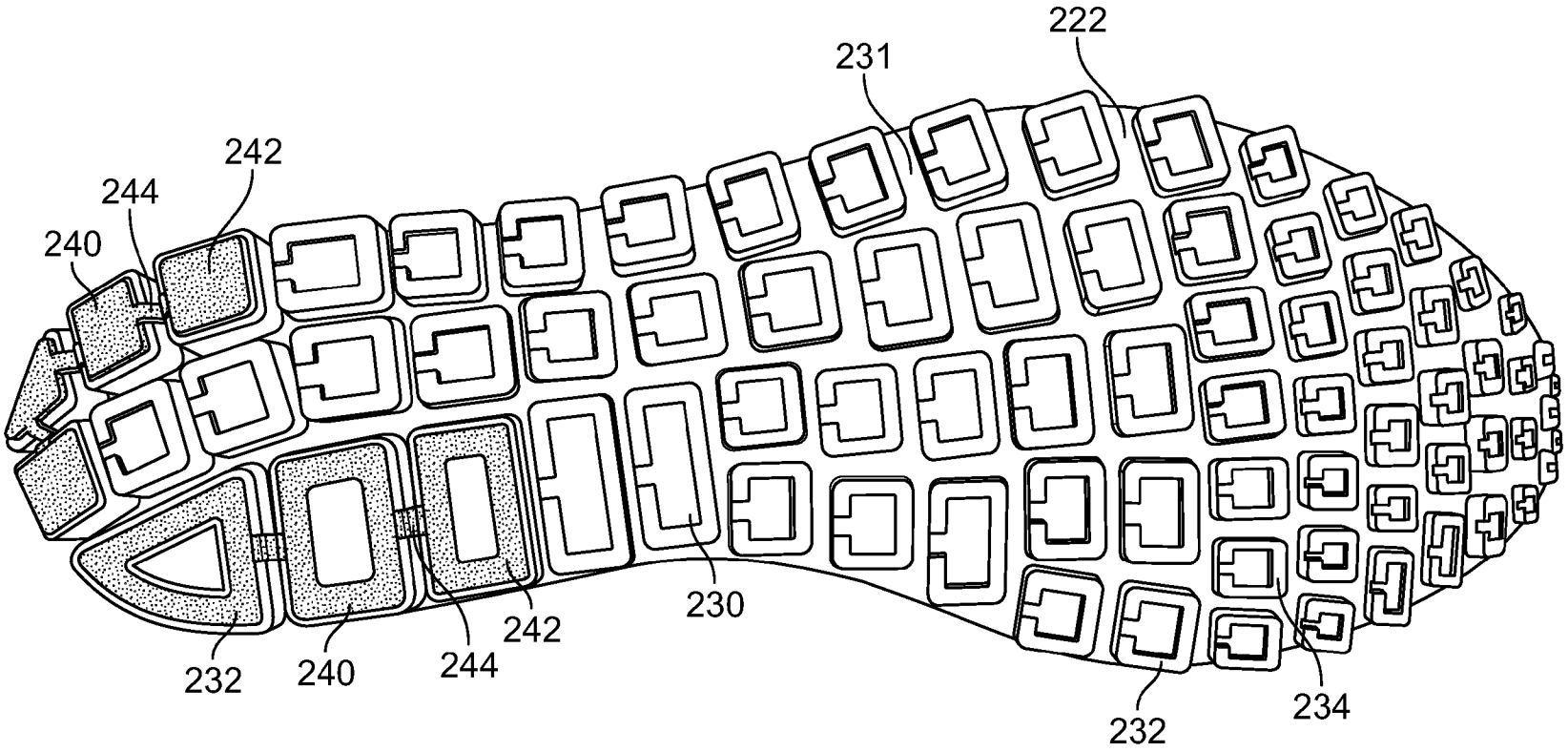
FIG. 11 is a bottom view of an exemplary sole and article of footwear according to an embodiment of the present invention.

As shown, for example in FIGS. 9-11, the forefoot portion 212 may include a plurality of smaller sized projections 230 in cross-sectional area relative to the midfoot portion 214 and the heel portion 216. The smaller forefoot projections may provide a more flexible sole 210 in the forefoot, which may be advantageous during the toe-off portion of the gait cycle, for example.

As shown, for example, in FIG. 9, in one embodiment the vertical height of projections 230 may generally decrease from heel portion 216 to forefoot portion 212. The area of the cross section of projections 230 may also generally decrease from heel portion 216 to forefoot portion 212. As discussed above in connection with FIG. 7, one or more outer projections 230 on the perimeter 226 of sole 210 may be angled away from the center of the sole 210 to provide a larger footprint and additional stability and/or cushioning to the wearer. Projections 230 can be angled in a manner that generally mirrors the angular pattern of the projections described above with reference to FIGS. 1-7. The number, vertical height, splay angle, density, shape, and cross-sectional area of the projections 230 can vary as desired. For example, sole 210 can be provided with fewer projections 230. When fewer projections 230 are provided, the projections 230 can be formed from higher density materials or can have a greater area such that the stability and cushioning of the sole 210 are not negatively affected. Alternately, if a softer feel is desired for a particular embodiment, fewer projections 230 can be provided without using higher density materials or larger areas.

As shown, for example, in FIGS. 10 and 11, in one embodiment one or more connecting members 240 may be provided to connect one or more projections 230. The connecting member 240 may provide additional stability to the sole 210 in that area. In one embodiment, the connecting member 240 may include a plurality of bases 242 connected by a bridge 244. The bases 242 may be connected to the bottom surface 235 of each of the projections 230 that are to be joined and may secured by adhesive or other suitable means. In one embodiment a base 242 may be disposed in the indention 238. In one embodiment, the connecting member 240 may be formed integrally with the sole 210 and/or projections 230 to form a unitary structure. In one embodiment, the connecting member 240 may comprise the same material as the sole 210 (e.g., foam) and may be formed with the sole 210 as a unitary structure. In other embodiments, the connecting member 210 may be formed as a separate component that may be attached to the sole.

In one embodiment, as shown in FIG. 10, a connecting member 240 may connect a plurality of inner projections 234 in the forefoot portion 212 generally in the area under the ball of the wearer's foot. The connecting member 240 may limit the deformation and/or separation of a projection relative to another connected projection so as to provide increased stability. In one embodiment, the connecting member 240 may connect three projections 230. In one embodiment, multiple rows of projections may be connected. For example, as shown in FIG. 10, three adjacent rows of inner projections 234 may be connected.

In another embodiment, a plurality of projections 230 in the heel portion 216 may be connected by one or more connecting members 240. As shown, for example, in FIG. 11, three outer projections 232 along the medial side perimeter of the sole 210 in the heel portion 216 may be connected to provide increase stability to this area. Additionally, or in the alternative, four outer projections 232 along the lateral side and rear perimeter of the sole 210 may be connected. Other combinations and arrangements of connecting members may be used to provide the desired level of stability.

With reference to FIG. 10, in one embodiment, all or a portion of the space 231 between adjacent projections 230 may be filled with an extension 246 extending from the base 222. In one embodiment, the extension 246 may connect adjacent sidewalls 233 of projections 230. The extension 246 may limit the deformation and/or separation of a projection relative to another connected projection so as to provide increased stability. The extension 246 may be formed integrally with the sole 210 and/or projections 230 to form a unitary structure, and in this manner may form a permanent structure of the sole 210 and may be permanently disposed in sole 210 during manufacture of footwear 100. In other embodiments, extension 246 may be readily removable from sole 210. For example, in one embodiment, an extension 246 may be inserted into space 231 between adjacent projections 230. The extension 246 may be attached with adhesive or the like, or may be "wedged" into place between adjacent projections 230. In this manner, connecting members 240 or extensions 246 may be sold "aftermarket", and a user may continually customize the stiffness or cushioning properties of footwear 100 depending on desired uses, aging of the shoe, or other conditions of use.

In one embodiment, a band may be disposed about one or more projections 230. The band may comprise, for example, an elastic band. The band may be used to alter the stiffness, cushioning, stability, ride, appearance and/or feel of the sole. In some embodiments, a groove may be formed on the sidewall 233 of the projection 230, and the band may be disposed in the groove. The band may be permanently attached during manufacturing, or may be removable. In embodiments, where the band is removable, the user may change bands to customize performance or appearance of the sole 210. For example, a collection of bands could be multi-colored and/or may have different elastic properties. In one embodiment, a kit including various bands may be sold such that a user can customize the sole.

The spaces 231 between projections 230 may be sufficiently deep and wide to provide adequate flexibility to the sole 210. In one embodiment, as shown for example in FIGS. 9-11, spaces 231 extend vertically into the sole 210 from the base 222 to the bottom surface 235 of the projections 230 and laterally between adjacent projections 230 to provide spacing that is wider than, for example, a groove, a laser etching, or sipe that may extend into the sole of previously known footwear. As a result, in embodiments of the present invention, the total surface area of the spaces 231 between the projections 230 provides a desired level of flexibility to the sole 210 while maintaining desired levels of cushioning and stability.

Figure 12:
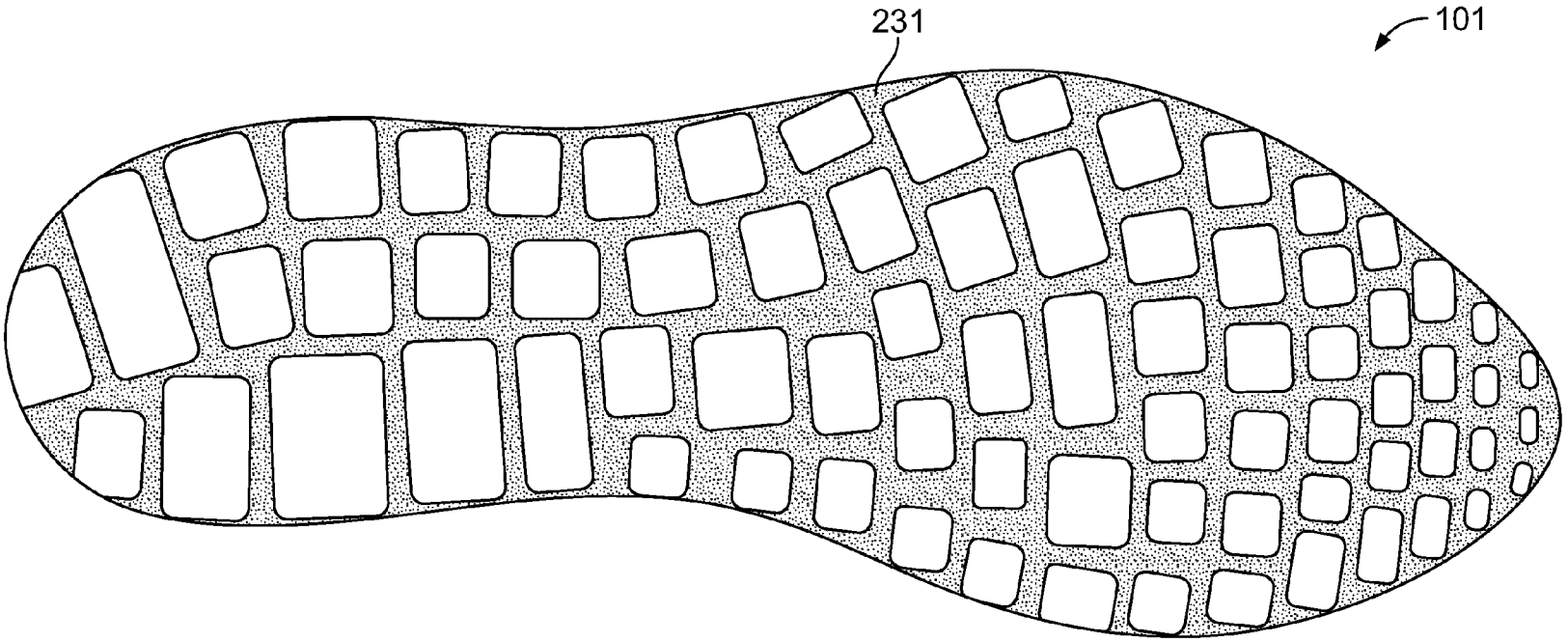
FIG. 12 is a schematic view of bottom surface area of an exemplary sole according to an embodiment of the present invention.
Figure 13:
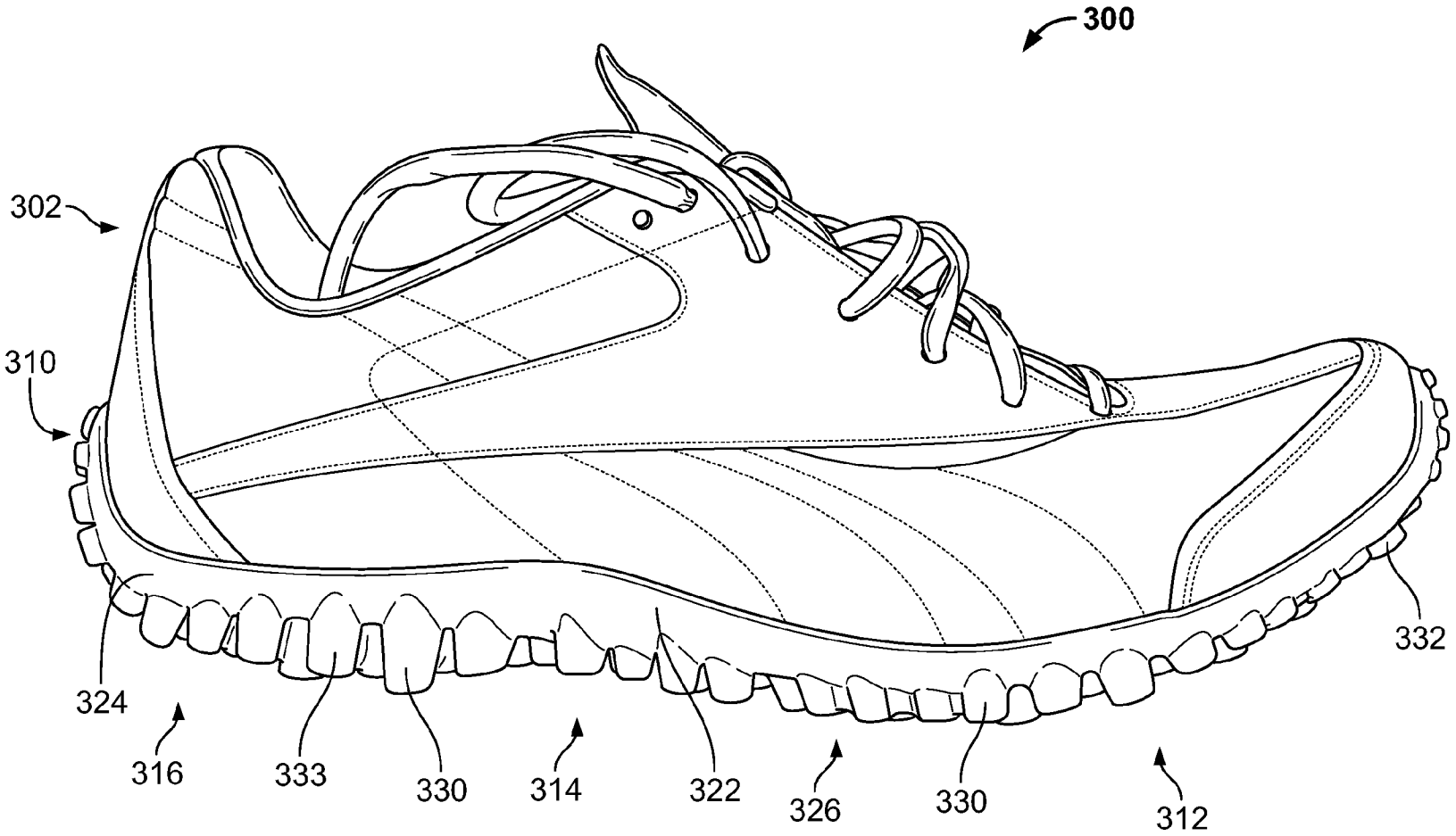
FIG. 13 is a lateral side view of an exemplary sole and article of footwear according to an embodiment of the present invention.
Figure 14:
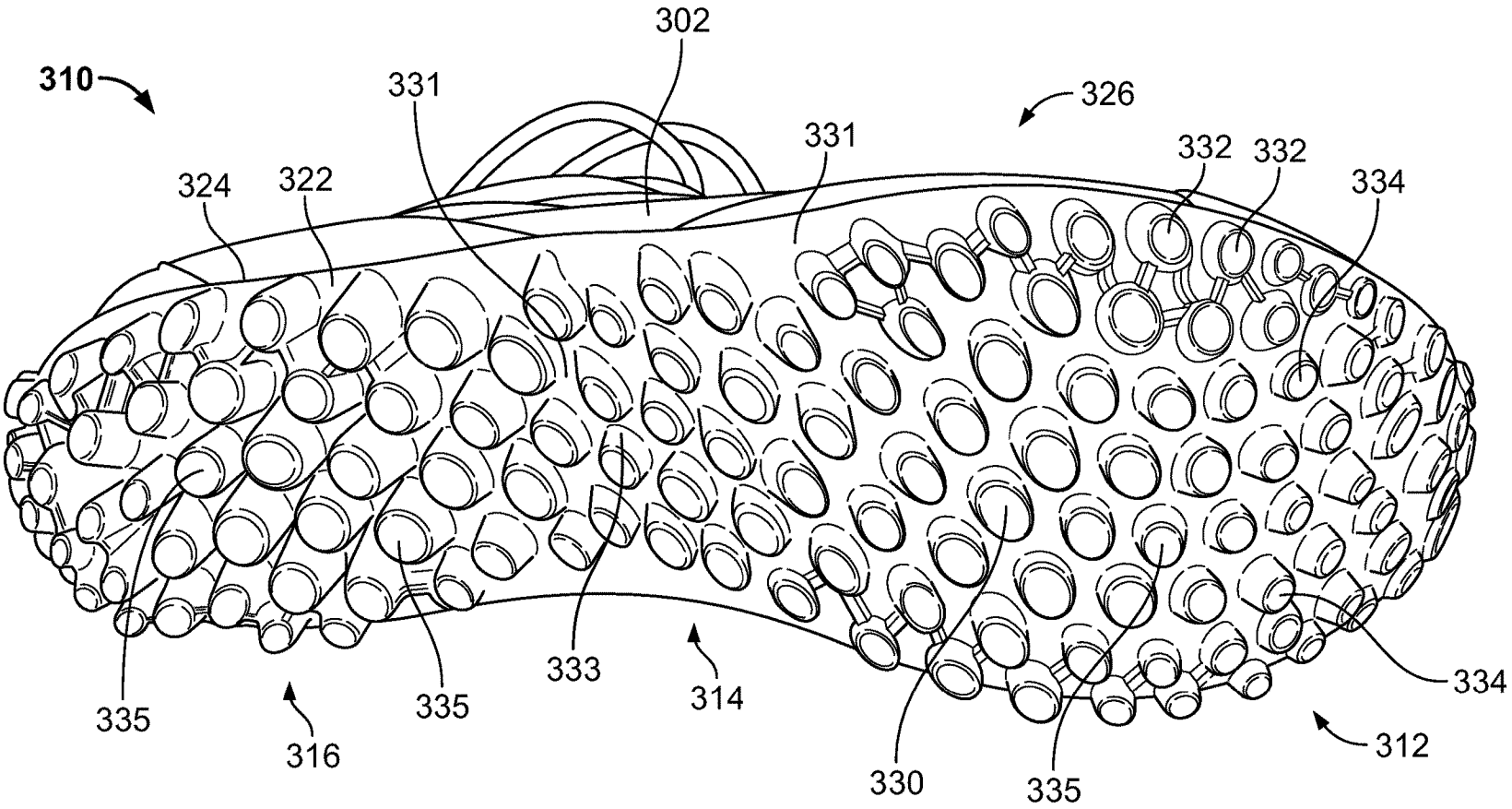
FIG. 14 is a bottom view of the exemplary sole and article of footwear of FIG. 13 according to an embodiment of the present invention.

FIG. 12 illustrates an exemplary bottom surface area "footprint" 101 of a sole according to an embodiment of the present invention. The bottom surface area is shown in connection with quadrilateral projections 230, but it is to be understood that this is exemplary only and the spacing may be used in conjunction with the cylindrical projections 130 shown in FIGS. 1-6, for example, or other suitable projections of the present invention. Moreover, as shown in FIG. 12, the total area of the sole 210 is defined as within the perimeter 226 and if sole 210 were flat bottomed and the extrusion area of all of the projections 230 were projected onto the surface. In one embodiment, the "empty" surface area between projections 230 defined by spaces 231 comprises about 40% of the total area of the sole. In one embodiment, the surface area between projections 230 defined by spaces 231 comprises at least about 10% of the total area. In one embodiment, the surface area between projections 230 defined by spaces 231 comprises at least about 20% of the total area. In one embodiment, the surface area between projections 230 defined by spaces 231 comprises at least about 30% of the total area. In one embodiment, the surface area between projections 230 defined by spaces 231 comprises at least about 40% of the total area. In one embodiment, the total area of the sole 210 within the perimeter 226 is about 240 $cm^2$ and the total area of the projections 230 projected onto a contact surface comprises about 146 $cm^2$ and the total area of spaces 231 is about 94 $cm^2$.

In one embodiment, the spaces 231 between adjacent projections may be non-uniform throughout the sole 210. In another embodiment, the spaces 231 between adjacent projections 230 may be uniform.

Another embodiment of the present invention will now be described with reference to FIGS. 13-16, in which like reference numerals refer to like elements. Footwear 300 may include a sole 310 and an upper 302 attached to the sole 310. The sole 310 may include a forefoot portion 312, a midfoot portion 314, and a heel portion 316. The sole 310 includes a plurality of lower projections 330 extending downwardly from the base 322 of the sole 310. The properties of the lower projections 330 including, but not limited to, the size, number, spacing, splay angle, and arrangement of the projections may be provided as those described above in connection with FIGS. 1-12, depending on the desired level of flexibility and/or cushioning to be provided by the sole 310.

The sole 310 includes a base 322 having an outer edge 324 which defines the perimeter 326 of the base 322. The lower projections 330 may include a plurality of outer projections 332 extending from the base 322 about the perimeter 326, and a plurality of inner projections 334 extending from the base 322 within the perimeter 326 and the outer projections 332. The lower projections 330 define spaces 331 between the projections. In one embodiment, as shown for example in FIG. 14, a plurality of outer projections 332 may be disposed about the entire perimeter 326 of the base 322. In other embodiments, outer projections 332 may be disposed only about a portion of the perimeter 326.

The projections 330 include a sidewall 333 extending from the base 322 at one end and terminating in a bottom surface 335 at another end. In one embodiment, the sidewall 333 may be curved and may taper away from the base 322 such that the lower projections 330 provide a generally conical shape. The bottom surface 335 may be substantially flat or may be rounded.

Figure 15:
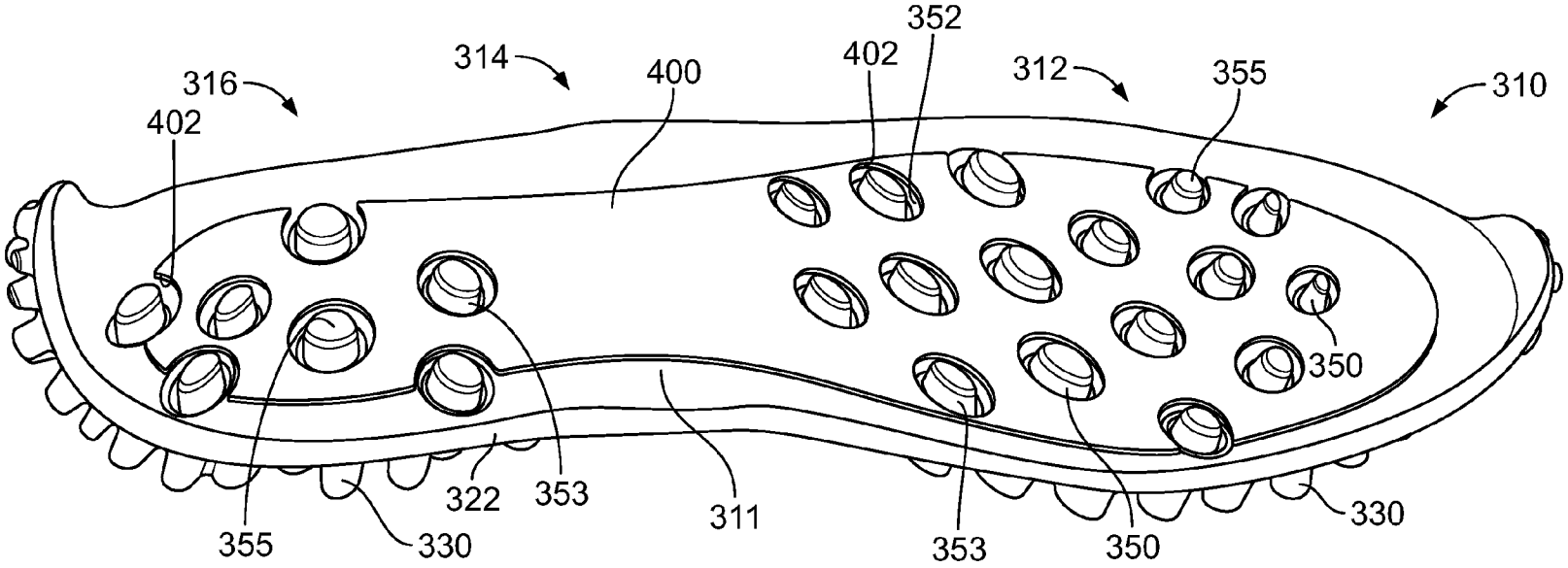
FIG. 15 is a perspective top view of one embodiment of the exemplary sole of FIG. 13.
Figure 16:
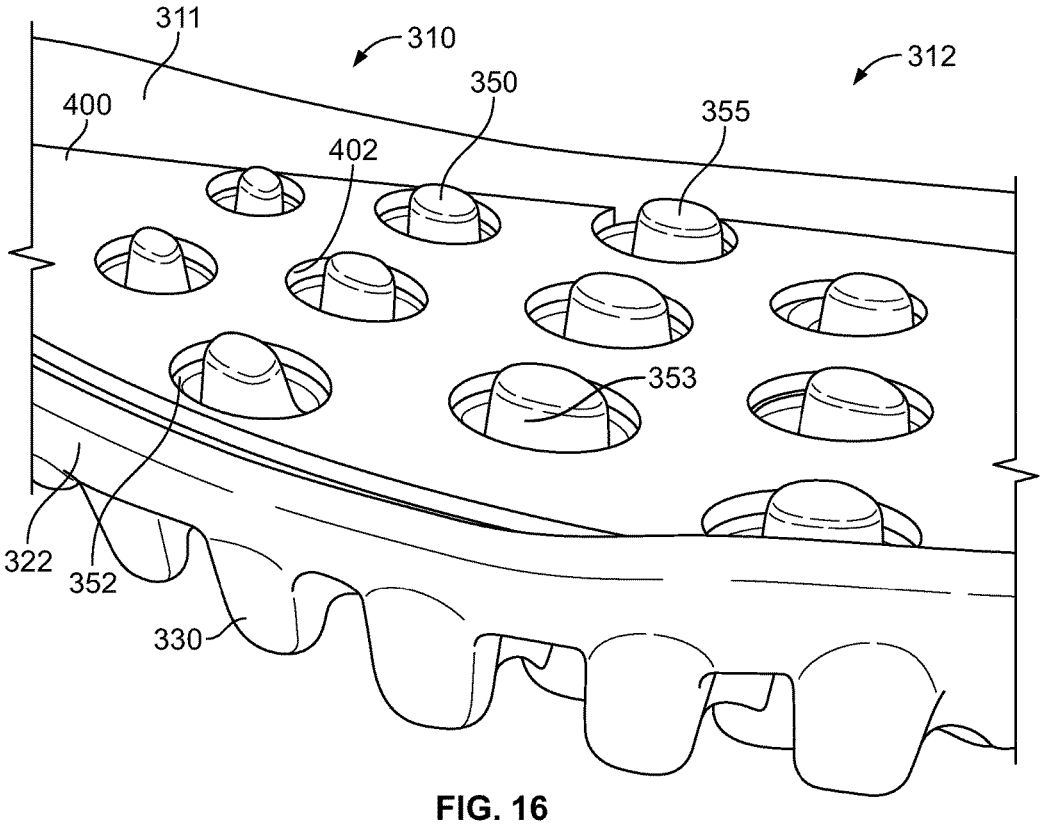
FIG. 16 is a partial perspective top view of one embodiment of the exemplary sole of FIG. 13.

With reference to FIGS. 15 and 16, a plurality of upper projections 350 may extend through openings 352 in an upper surface 311 of the sole 310. The upper surface 311 may comprise the top surface of the sole 310 which is shaped to receive the foot of the wearer. The upper projections 350 include a sidewall 353 and a top surface 355. In one embodiment, a plate 400 may be disposed on the upper surface 311 of the sole 310. In one embodiment, the plate 400 may comprise a less resilient material than the sole 310, including, but not limited to, compressed cellulose, plastic, TPU, foam, and the like, so as to provide stability to the sole. In one embodiment, the plate 400 may comprise a sockliner. The plate 400 includes a plurality of voids 402 through which the upper projections 350 may extend. The voids 402 may comprise complete openings (e.g., circular openings) or may comprise partial openings where one or more voids 402 may intersect with the outer edge of the plate 400. In one embodiment, the lower projections 330 and the upper projections 350 are not discrete components, but rather form unitary structures. In this manner, a lower projection and an upper projection may be the same. The base 322, the upper projections 350, and the lower projections 330 may be formed together (e.g., co-molded) as a unitary structure, or one or more may be formed separately and attached.

One or more upper projections 350 may be disposed on or adjacent one or more lower projections 330. During use, as force is applied to the lower projections 330, all or a portion of the force may be translated to the upper projections 350, which, in turn, may be caused to push upward. The upward movement of the upper projections 350 causes the upper surface 355 to act indirectly or directly against the foot of the wearer and provide a cushioning, tactile sensation, and/or massaging effect. In some embodiments, upward movement of the upper projections 350 against a wearer's foot may provide greater ground feel, or awareness, to the wearer. In one embodiment, some or all of the lower projections 330 and the upper projections 350 may align so that all of the force acting on the lower projections 330 during use translate to the upper projections. In another embodiment, some or all of the upper projections 350 may be offset from the lower projections 330 so that less than all of the force acting on the lower projections 330 during use translate to the upper projections.

The upper surface 355 may be shaped to provide the desired cushioning, tactile sensation, and/or massaging effect. In one embodiment, the upper surface 355 may be flat, convex, or concave. In one embodiment, the upper surface 355 may include smaller protrusions, bumps, or ridges to provide increased tactile sensations on the foot.

In one embodiment, as shown, for example, in FIGS. 15 and 16, there may be fewer upper projections 350 than lower projections 330. The number, location, and arrangement of the upper projections 350 may vary depending on the desired cushioning and/or massaging effect. In one embodiment, upper projections 350 extend through openings in the upper surface 311 in one or more of the forefoot portion 312, the midfoot portion 314, and the heel portion 316. In one embodiment, upper projections 350 extend in the heel portion and the forefoot portion only.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A sole for an article of footwear, comprising:

a base adapted to be attached to an upper, the base having an outer edge defining a perimeter;

a plurality of resilient outer projections extending from the base at a base end about the perimeter, each outer projection having a central axis and a bottom end opposite the base end;

a plurality of resilient inner projections extending from the base within the outer projections, each inner projection having a central axis; and a connecting member connecting at least two of the plurality of resilient inner projections in a forefoot portion of the sole, wherein the central axes of the plurality of inner projections are substantially parallel, and wherein the central axes of the plurality of outer projections are non-parallel with the central axes of the plurality of inner projections, wherein the ratio of height to width of one or more of the plurality of outer projections at the base end and the bottom end is at least two, and wherein the connecting member only connects laterally adjacent resilient inner projections.

2. The sole of claim 1, wherein the plurality of outer projections comprise foam.

3. The sole of claim 1, wherein the base, the plurality of outer projections, and the plurality of inner projections comprise foam.

4. The sole of claim 1, wherein the base comprises a first material and the plurality of outer projections comprise a second material different from the first material.

5. The sole of claim 1, wherein each of the plurality of projections has a width, and wherein the four of the plurality of projections having the greatest widths are disposed in a heel portion on a medial side of the base.

6. The sole of claim 1, wherein the ratio of height to width of one or more of the plurality of outer projections in a heel portion of the article of footwear is at least two.

7. The sole of claim 1, wherein the plurality of outer projections and inner projections are cylindrical.

8. The sole of claim 1, wherein the plurality of outer projections and inner projections are quadrilateral in cross-section.

9. The sole of claim 1, wherein at least two of the plurality of outer projections are rectangular in cross section and at least two of the plurality of inner projections are square in cross-section.

10. The sole of claim 1, wherein the base is adapted to form an external surface of the article of footwear.

11. The sole of claim 1, wherein a bottom surface of the plurality of outer projections and inner projections are ground contacting surfaces.

12. The sole of claim 1, wherein a splay angle formed between the central axis of at least one of the plurality of resilient inner projections and the central axis of at least one of the plurality of resilient outer projections is between about ten degrees to about twenty five degrees.

13. The sole of claim 1, wherein a splay angle formed between the central axis of at least one of the plurality of resilient inner projections and the central axis of at least one of the plurality of resilient outer projections is about fourteen degrees.

14. A sole for an article of footwear comprising:

a base having a forefoot portion and a heel portion;

a plurality of resilient projections extending from the base, each projection having a sidewall and a bottom surface;

a plurality of bases disposed on the bottom surfaces of at least two adjacent projections in the forefoot portion;

a bridge formed from a different material than the two adjacent projections that connects the plurality of bases disposed on the bottom surfaces of the at least two adjacent projections in the forefoot portion; and an extension disposed between and connecting the sidewalls of at least two adjacent projections in the heel portion that extends from the base and is formed from the same material as the two adjacent projections, wherein the bridge only connects laterally adjacent bases in a medial-lateral direction.

15. The sole of claim 14, wherein the at least two adjacent projections in the forefoot portion comprise three adjacent projections in the forefoot portion that are connected by bridges, wherein the bridges form a row.

16. The sole of claim 14, wherein the at least two adjacent projections in the forefoot portion comprise three discrete sets of three adjacent projections in the forefoot portion that are connected by bridges within each set, wherein the bridges form three rows, and wherein the bridges of each discrete row runs parallel to one another.

17. The sole of claim 14, wherein the at least two adjacent projections in the heel portion are located along the medial side of the heel portion.

18. The sole of claim 14, wherein the bridge is formed separately from the at least two adjacent projections in the forefoot portion prior to connection.

19. The sole of claim 14, wherein the bridge is formed integrally with the at least two adjacent projections in the forefoot portion.

20. The sole of claim 14, wherein the extension is formed integrally with the base and the at least two adjacent projections in the heel portion.

21. The sole of claim 14, wherein the at least two adjacent connected projections in the heel portion are larger than the at least two adjacent connected projections in the forefoot portion.

22. The sole of claim 14, wherein the vertical heights of the projections decrease from the heel portion to the forefoot portion.

23. A sole for an article of footwear comprising:

a plurality of resilient projections extending downward from the sole, each projection having a bottom surface;

a plurality of outsole components coupled to the bottom surfaces of the plurality of resilient projections, each outsole component having a bottom surface; and a connecting member that connects at least two adjacent outsole components in a forefoot portion of the sole, the connecting member comprising a plurality of bases disposed on the bottom surfaces of the at least two adjacent outsole components and a bridge that connects the plurality of bases, wherein the connecting member only connects laterally adjacent outsole components in a medial-lateral direction, wherein the plurality of resilient projections are integrally formed with one another and comprise a first material, wherein the plurality of outsole components and the connecting member comprise a second material that is more wear resistant than the first material.

24. The sole of claim 23, further comprising an extension that comprises the first material disposed between and connecting at least two adjacent resilient projections.

25. The sole of claim 24, wherein the extension is integrally formed with the at least two adjacent projections.

26. The sole of claim 23, wherein the at least two adjacent outsole components that are connected by the connecting member are coupled to the bottom surfaces of at least two adjacent resilient projections that are connected by an extension that comprises the first material.

27. The sole of claim 26, wherein the extension is integrally formed with the at least two adjacent projections.

28. The sole of claim 23, wherein the plurality of resilient projections are non-uniform in length.

29. The sole of claim 23, wherein the plurality of resilient projections are non-uniform in width.

30. The sole of claim 23, wherein the plurality of resilient projections substantially cover the forefoot portion, a midfoot portion, and a heel portion of the sole.

31. The sole of claim 23, wherein the vertical heights of the plurality of resilient projections decrease from a heel portion of the sole to the forefoot portion of the sole.

* * * * *